US007766662B2

(12) United States Patent
Akama et al.

(10) Patent No.: US 7,766,662 B2
(45) Date of Patent: Aug. 3, 2010

(54) SURFACE MOUNT COAXIAL CONNECTOR ASSEMBLY

(75) Inventors: Junichi Akama, Shinagawa (JP); Hideo Miyazawa, Shinagawa (JP); Koki Sato, Shinagawa (JP); Mitsuru Kobayashi, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/068,035

(22) Filed: Jan. 31, 2008

(65) Prior Publication Data

US 2009/0011619 A1 Jan. 8, 2009

(30) Foreign Application Priority Data

Jul. 2, 2007 (JP) ..... 2007-174010

(51) Int. Cl.
*H01R 12/00* (2006.01)

(52) U.S. Cl. ..... 439/63; 439/581

(58) Field of Classification Search ..... 439/63, 439/581, 582, 585, 83
See application file for complete search history.

(56) References Cited

U.S. PATENT DOCUMENTS 3,384,703 A * 5/1968 Forney, Jr. et al. ..... 174/75 C
4,795,352 A * 1/1989 Capp et al. ..... 439/63
5,055,068 A * 10/1991 Machura et al. ..... 439/581
5,120,258 A * 6/1992 Carlton ..... 439/581
5,662,480 A * 9/1997 Togashi ..... 439/63
5,940,966 A * 8/1999 Fasano et al. ..... 29/842
6,086,383 A * 7/2000 Fasano et al. ..... 439/63
6,312,287 B1 * 11/2001 Harting et al. ..... 439/581
7,196,532 B2 * 3/2007 Kang ..... 324/761

FOREIGN PATENT DOCUMENTS

JP 10-289767 10/1998
JP 2000-278837 10/2000
JP 2002-198137 7/2002
JP 2003-178844 6/2003

* cited by examiner

*Primary Examiner*—Edwin A. Leon
*Assistant Examiner*—Vanessa Girardi
(74) *Attorney, Agent, or Firm*—Staas & Halsey LLP

(57) ABSTRACT

A disclosed coaxial connector can be surface-mounted on a circuit board without degradation in signal transmission characteristics. The coaxial connector includes a center conductor, a surrounding conductor by which the center conductor is surrounded, and an insulating housing. The center conductor has a leg portion at its base end. The surrounding conductor has six lugs at its base end that extend radially. The leg portion and the lugs are exposed on a bottom surface of the housing. The coaxial connector is mounted on the circuit board with the leg portion pressed against a signal pad on the circuit board for electrical connection and the lugs pressed against a ground pad for electrical connection.

4 Claims, 29 Drawing Sheets

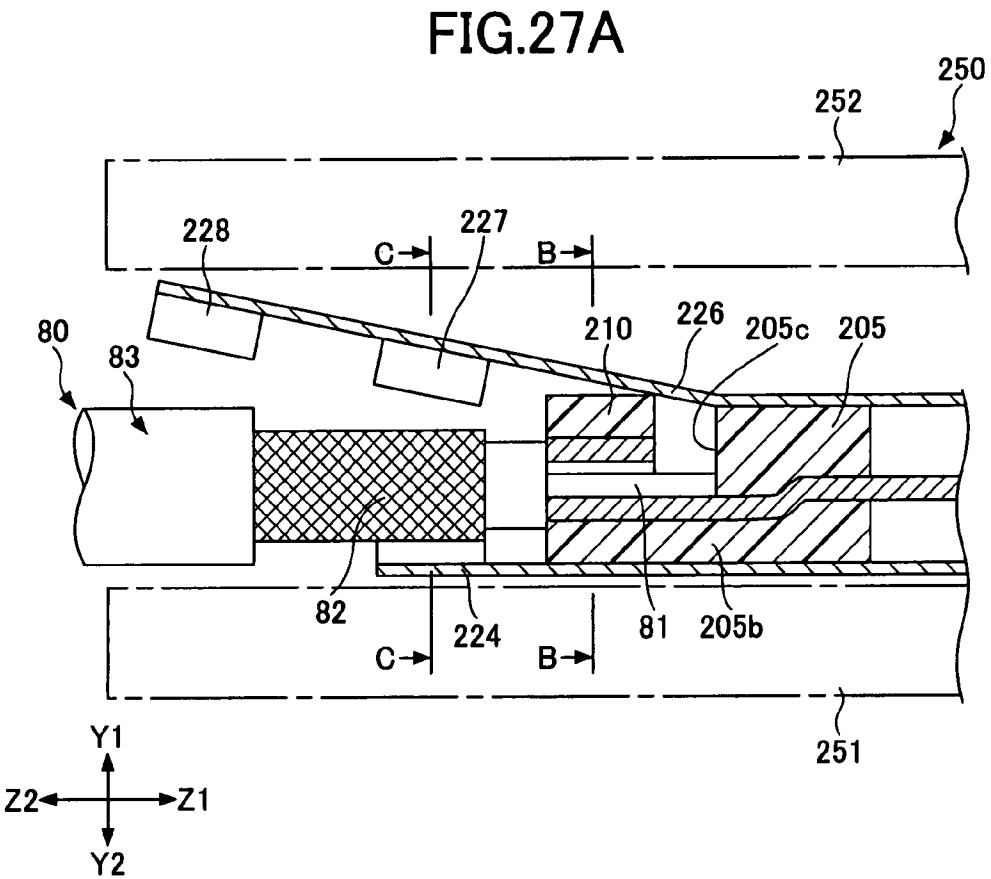
FIG.27A
250
252
251
205
205c
226
210
205b
81
227
228
224
82
83
80
B
C
Z1
Z2
Y1
Y2
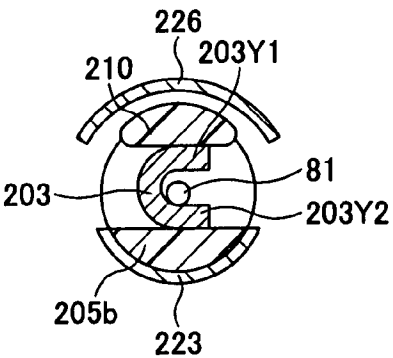
FIG.27B
226
203Y1
210
81
203Y2
203
205b
223
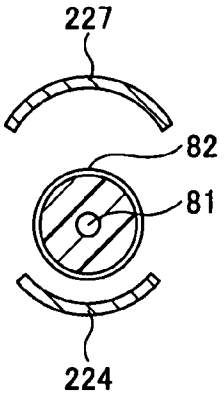
FIG.27C
227
82
81
224
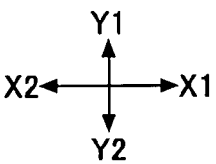
X1
X2
Y1
Y2

SURFACE MOUNT COAXIAL CONNECTOR ASSEMBLY

BACKGROUND OF THE INVENTION

1. Field of the Invention

The present invention relates to coaxial connectors, particularly to a coaxial connector that is surface-mounted on a circuit board and can be used in high-frequency signal transmission paths.

2. Description of the Related Art

FIG. 1A shows a conventional coaxial connector 1 that is mounted on a circuit board 10. The coaxial connector 1 comprises a core center conductor 2 disposed at the center, an insulating member 3 surrounding the center conductor 2, and a cylindrical surrounding conductor 4 that surrounds the insulator 3. A lower-end portion 2*a* of the center conductor 2 protrudes downward beyond the insulating member 3. The surrounding conductor 4 has a flange portion 4*a* at the lower end.

FIG. 1B shows a portion of the circuit board 10 where the coaxial connector 1 is mounted. The circuit board 10 has a throughhole 11 through which the lower-end portion 2*a* of the center conductor 2 penetrates. On the upper surface of the circuit board 10, a ring-shaped ground pad 12 is formed about the throughhole 11. On the lower surface, a ring-shaped pad 13 is formed about the throughhole 11.

As shown in FIG. 1C, the coaxial connector 1 is mounted on the circuit board 10 by soldering the periphery of the flange portion 4*a* to the ground pad 12 with a solder portion 20 and soldering the lower-end portion 2*a* of the center conductor 2, which penetrates downward through the throughhole 11, to the pad 13 with a solder portion 21.

With the coaxial connector 1 thus mounted on the circuit board 10, a coaxial connector 31 affixed to the end of a coaxial cable 30 is coupled.

In this conventional example, the solder portions 20 and 21 at the two locations of the assembly produce inductance. This inductance could be of such a value that degradation in signal transmission characteristics at the coaxial connector 1 cannot be disregarded in cases involving high-frequency transmission signals of several 10 GHz or above.

Furthermore, the throughhole 11 that needs to be formed in the circuit board 10 for mounting the coaxial connector 1 can cause degradation in signal transmission characteristics that cannot be disregarded when the transmitted signal is on the order of several 10 GHz or above.

SUMMARY OF THE INVENTION

It is therefore a general object of the present invention to overcome the aforementioned problems.

A more specific object of the invention is to provide a coaxial connector that can be mounted on a substrate without degradation in transmitted signal characteristics.

In one aspect, the invention provides a coaxial connector for mounting on a substrate, the coaxial connector comprising an insulating housing; a center conductor fixed to the housing; and a surrounding conductor fixed to the housing in such a manner as to surround the center conductor. The center conductor has a base portion that is exposed on a lower surface of the housing. The surrounding conductor has a base portion that is also exposed on the lower surface of the housing.

In one embodiment, the coaxial connector is mounted on a substrate with the base portion of the center conductor and the base portion of the surrounding conductor, which are exposed on the lower surface of the housing, each pressed against a pad disposed on the substrate. Thus, electrical connection can be established without any increase in inductance. Accordingly, the coaxial connector can be mounted on the substrate without degradation in signal transmission characteristics.

These and other objects, features and advantages of the invention will be apparent to those skilled in the art from the following detailed description of the invention, when read in conjunction with the accompanying drawings.

BRIEF DESCRIPTION OF THE DRAWINGS

FIG. 27A shows a cross section of the coaxial-cable-side coaxial connector before being crimped;

FIG. 27B shows a cross section taken along line B-B of FIG. 27A;

FIG. 27C shows a cross section taken along line C-C of FIG. 27A;

DETAILED DESCRIPTION OF THE PREFERRED EMBODIMENTS

In the following, the present invention is described by way of embodiments with reference made to the drawings.

Embodiment 1

Coaxial Connector

Figure 1A:
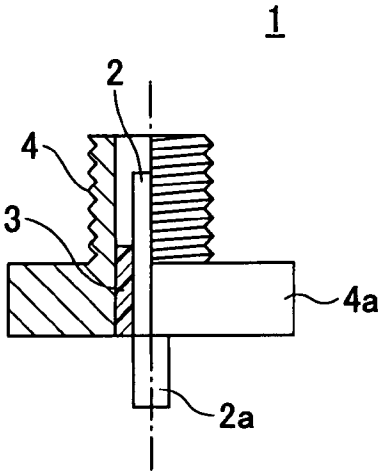
FIG. 1A shows a partially cross-sectional view of a conventional surface-mounted coaxial connector.
Figure 1B:
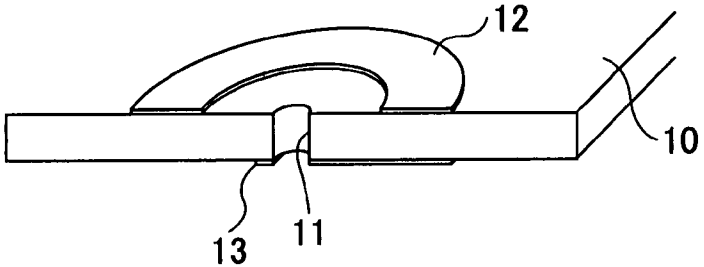
FIG. 1B shows a substrate on which the coaxial connector of FIG. 1A is to be mounted.
Figure 1C:
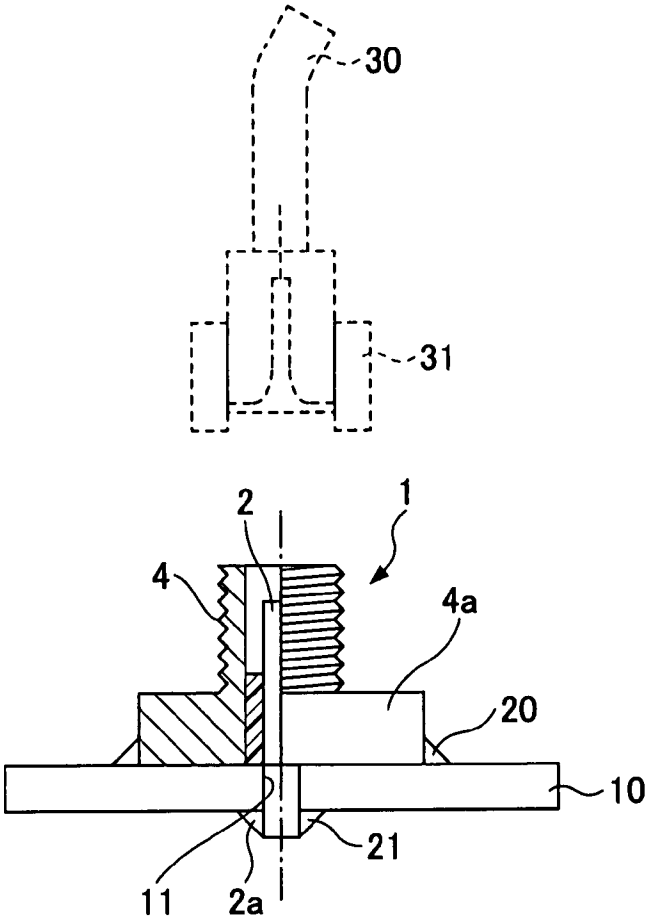
FIG. 1C shows the coaxial connector of FIG. 1B mounted on the substrate of FIG. 1B.
Figure 2:
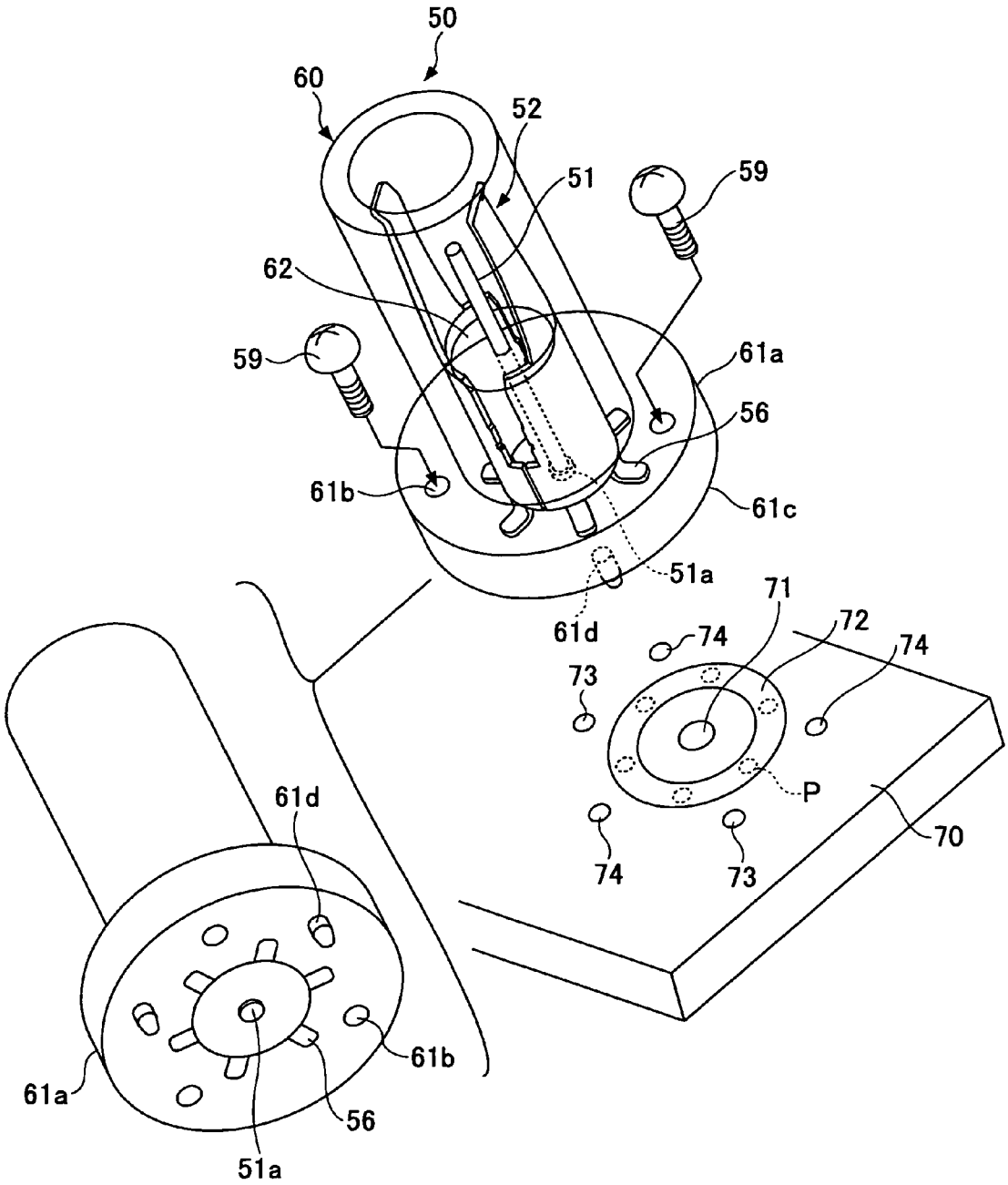
FIG. 2 is a perspective transparent view of a coaxial connector according to an embodiment of the invention, shown together with a circuit board on which it is mounted.
Figure 3:
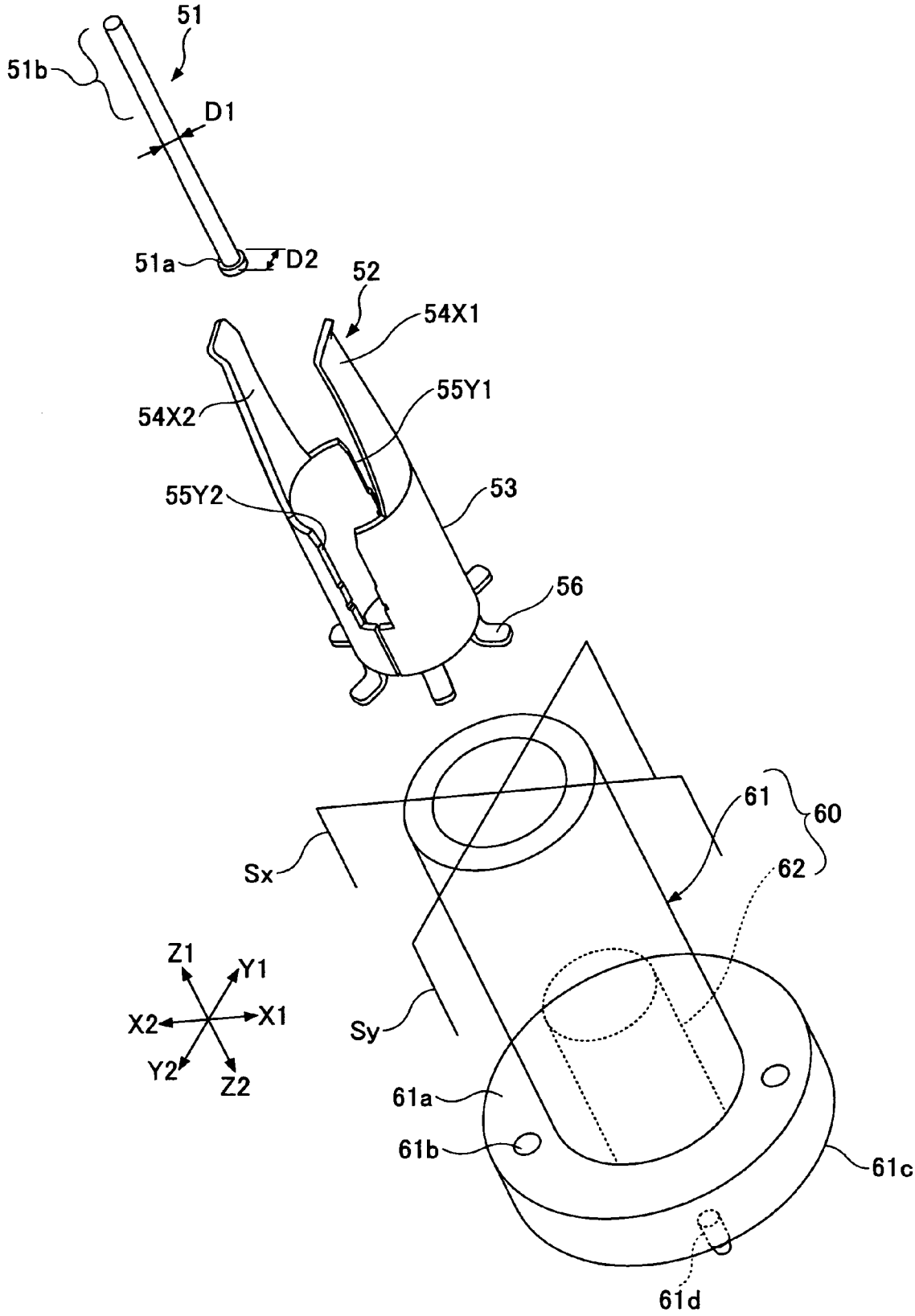
FIG. 3 shows an exploded perspective view of the coaxial connector of FIG. 2.
Figure 4C:
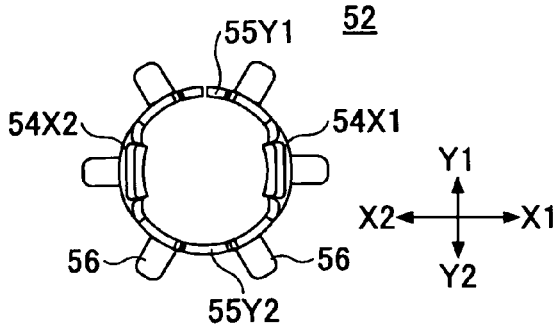
FIG. 4C shows a top plan view of the surrounding conductor.
Figure 4A:
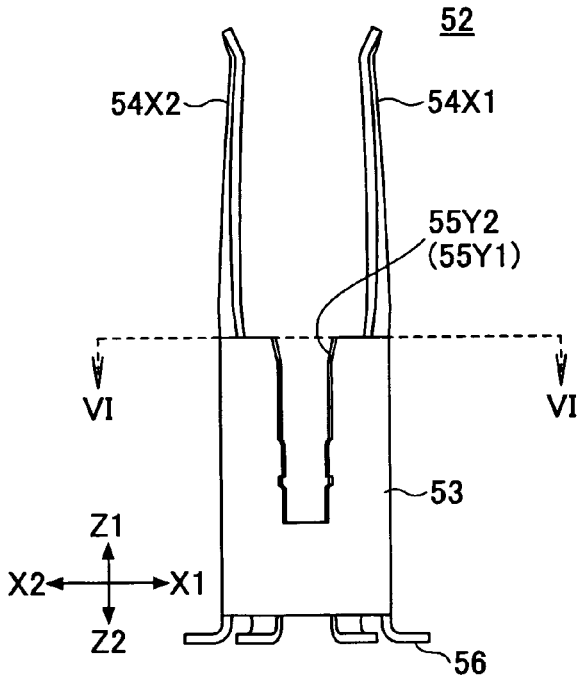
FIG. 4A shows an elevational view of a surrounding conductor seen from a Y1-Y2 direction.
Figure 4B:
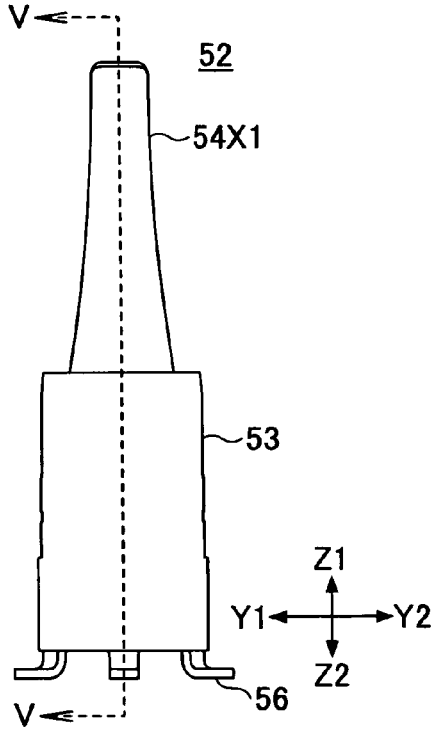
FIG. 4B shows another elevational view of the surrounding conductor seen from an X1-X2 direction.
Figure 4D:
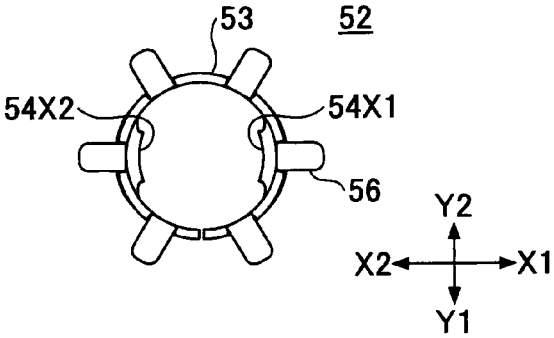
FIG. 4D shows a bottom plan view of the surrounding conductor.

FIG. 2 is a transparent view of a coaxial connector 50 according to a first embodiment of the invention, shown together with a corresponding circuit board 70 on which the connector is mounted. FIG. 2 also partly shows the bottom surface of the coaxial connector 50 toward Z2. FIG. 3 is an exploded view of the coaxial connector 50.

With reference to FIG. 3, line Z1-Z2 indicates the axis of the coaxial connector 50, Z1 pointing the tip end and Z2 pointing the base end. Line X1-X2 indicates the direction in which a pair of contact portions 54X1 and 54X2, which will be described later, is disposed (i.e., along a plane SX). Line Y1-Y2 is the direction perpendicular to line X1-X2 (i.e., along a plane SY).

The coaxial connector 50 comprises a center conductor 51 disposed at the center for signal transmission, a surrounding conductor 52 disposed to surround the center conductor 52 and provide ground potential when mounted, and an insulating housing 60. The coaxial connector is thus a male component adapted to be surface-mounted on a circuit board. It may have a characteristic impedance of 50Ω, and can be used in high frequency signal transmission paths of several 10 GHz or above.

The center conductor 51 is pin-shaped and has a diameter D1 and a leg portion 51*a* at its base end. The leg portion 51*a* has a diameter D2 which is approximately twice D1. The leg portion 51*a* is disc-shaped like a nail head; it may be formed by striking the end of the center conductor 51 in a press machine.

Figure 5:
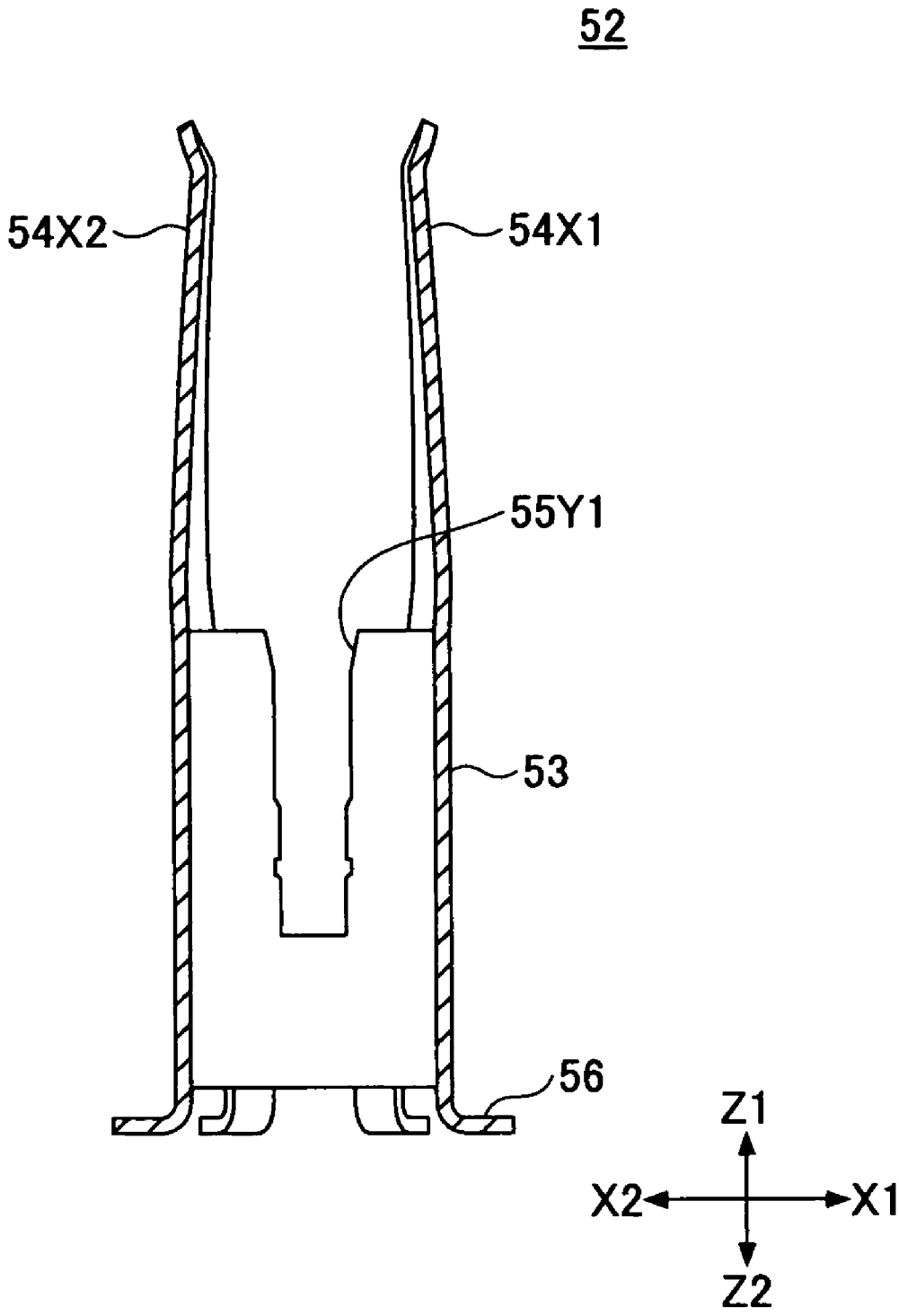
FIG. 5 shows a longitudinal cross section of the surrounding conductor taken along line V-V shown in FIG. 4B.
Figure 6:
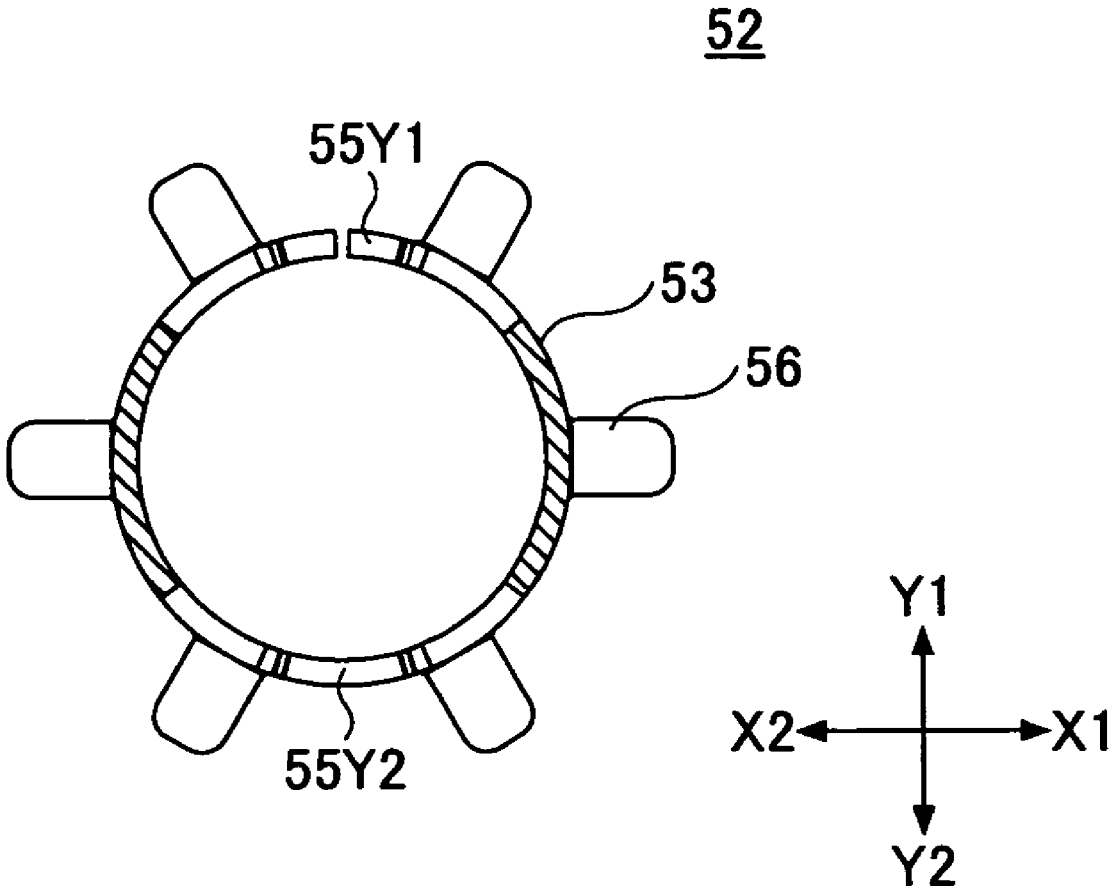
FIG. 6 shows a lateral cross section of the surrounding conductor taken along line VI-VI shown in FIG. 4A.

FIGS. 4A-4D, 5, and 6 show the surrounding conductor 52. FIG. 5 is a cross section taken along line V-V of FIG. 4B. FIG. 6 is a cross section taken along line VI-VI of FIG. 4A. As shown in FIGS. 4A-4D, 5, and 6, the surrounding conductor 52 may be made by forming a metal plate punched in a predetermined shape into a cylinder. Specifically, it comprises a cylinder portion 53; a pair of contact portions 54X1 and 54X2 that extend in the Z1 direction from an upper end of the cylinder portion 53 where its sides are opposite to each other along the X1-X2 direction; and six lugs 56 that radially extend from the lower end of the cylinder portion 53.

The cylinder portion 53 has a pair of cutout portions 55Y1 and 55Y2 formed therein. The cutout portions 55Y1 and 55Y2 are formed opposite each other in the Y1-Y2 direction, between the pair of contact portions 54X1 and 54X2 along the circumference, by cutting out the cylinder portion 53 from its upper end in the Z2 direction.

The pair of contact portions 54X1 and 54X2 is configured to elastically deform in a direction such that they become more spaced apart from each other.

The six lugs 56 are disposed at regular angular intervals.

Figure 7:
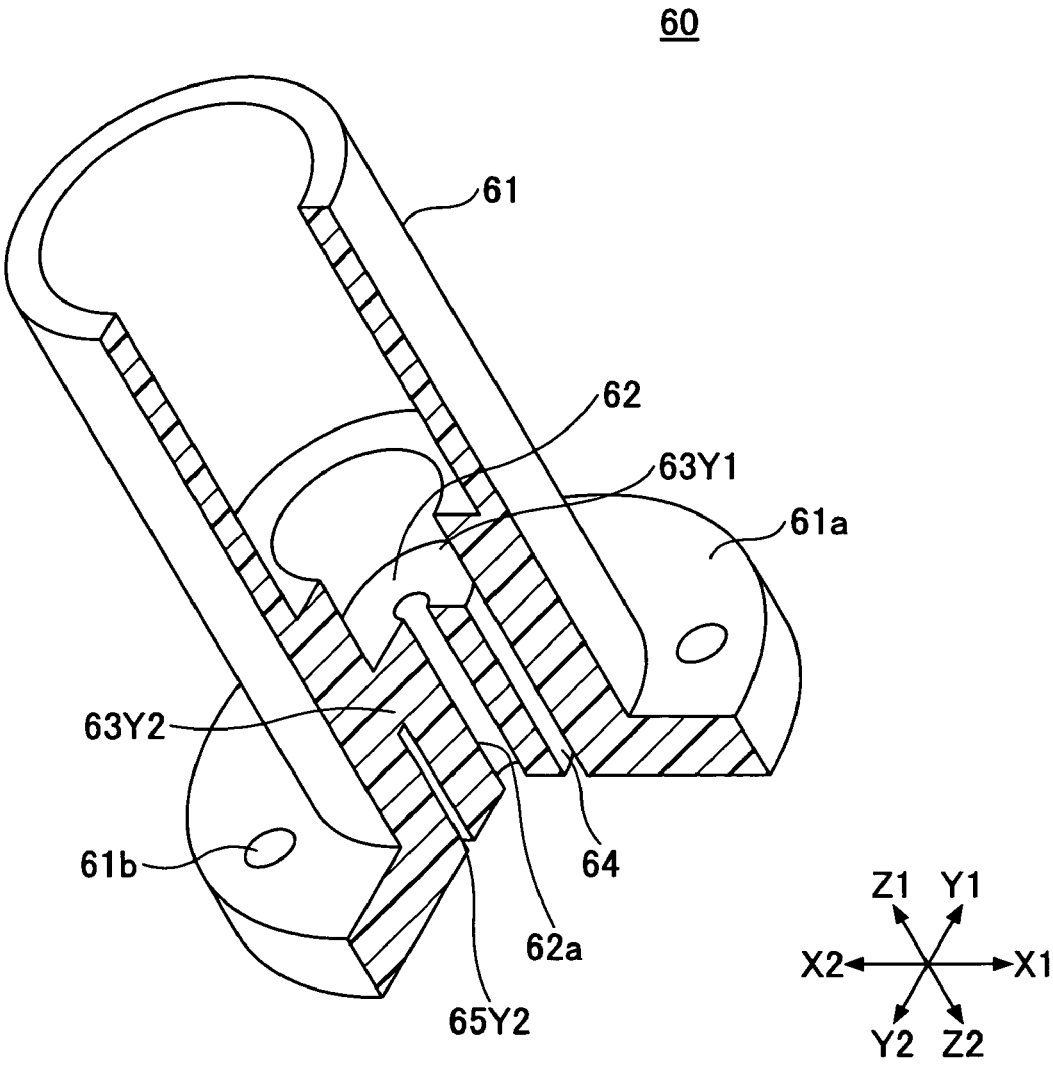
FIG. 7 is a perspective view of the housing of FIG. 3 which is partially cut in orthogonal planes.
Figure 8:
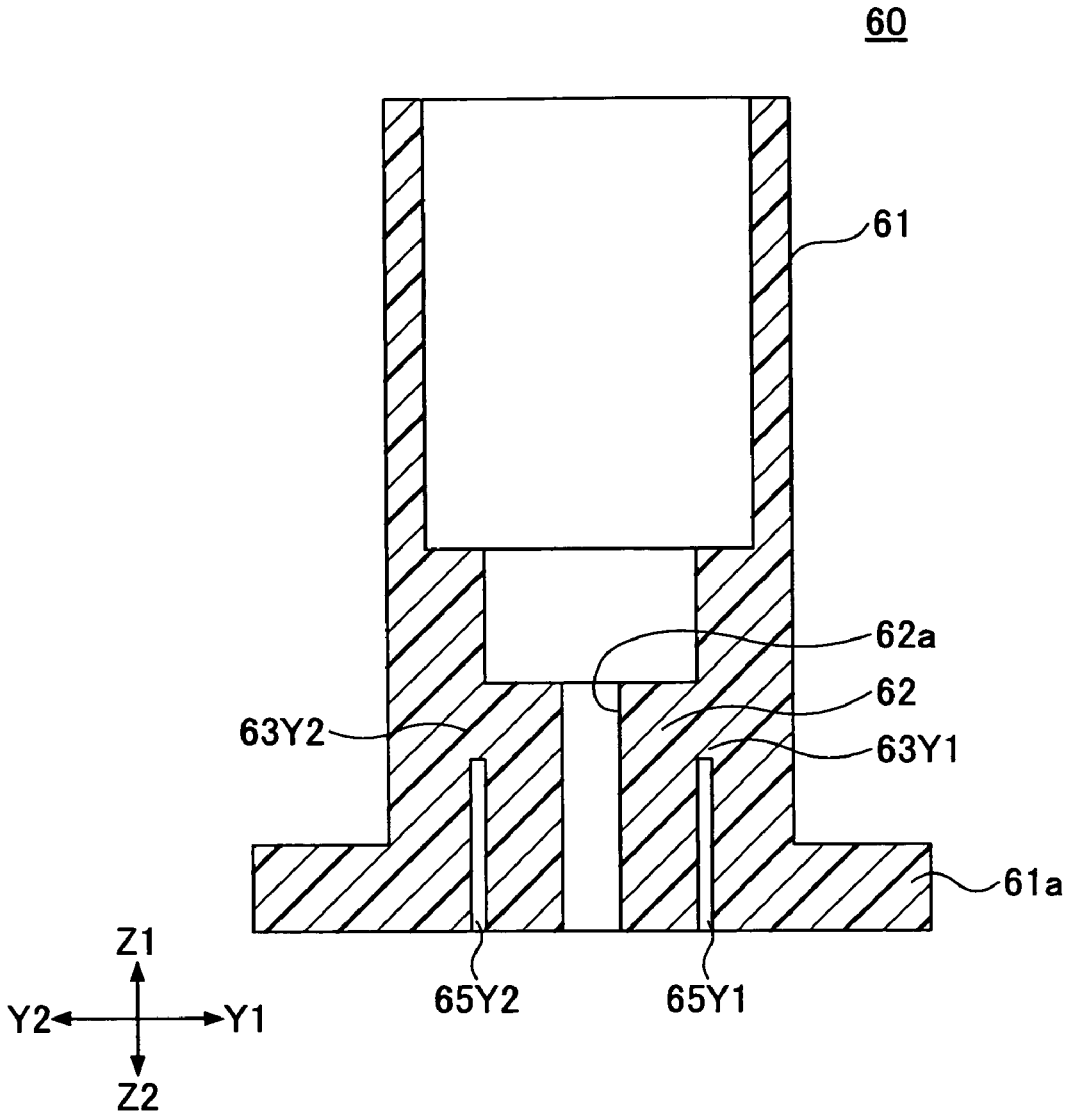
FIG. 8 shows a cross section SX of the housing of FIG. 3.
Figure 9:
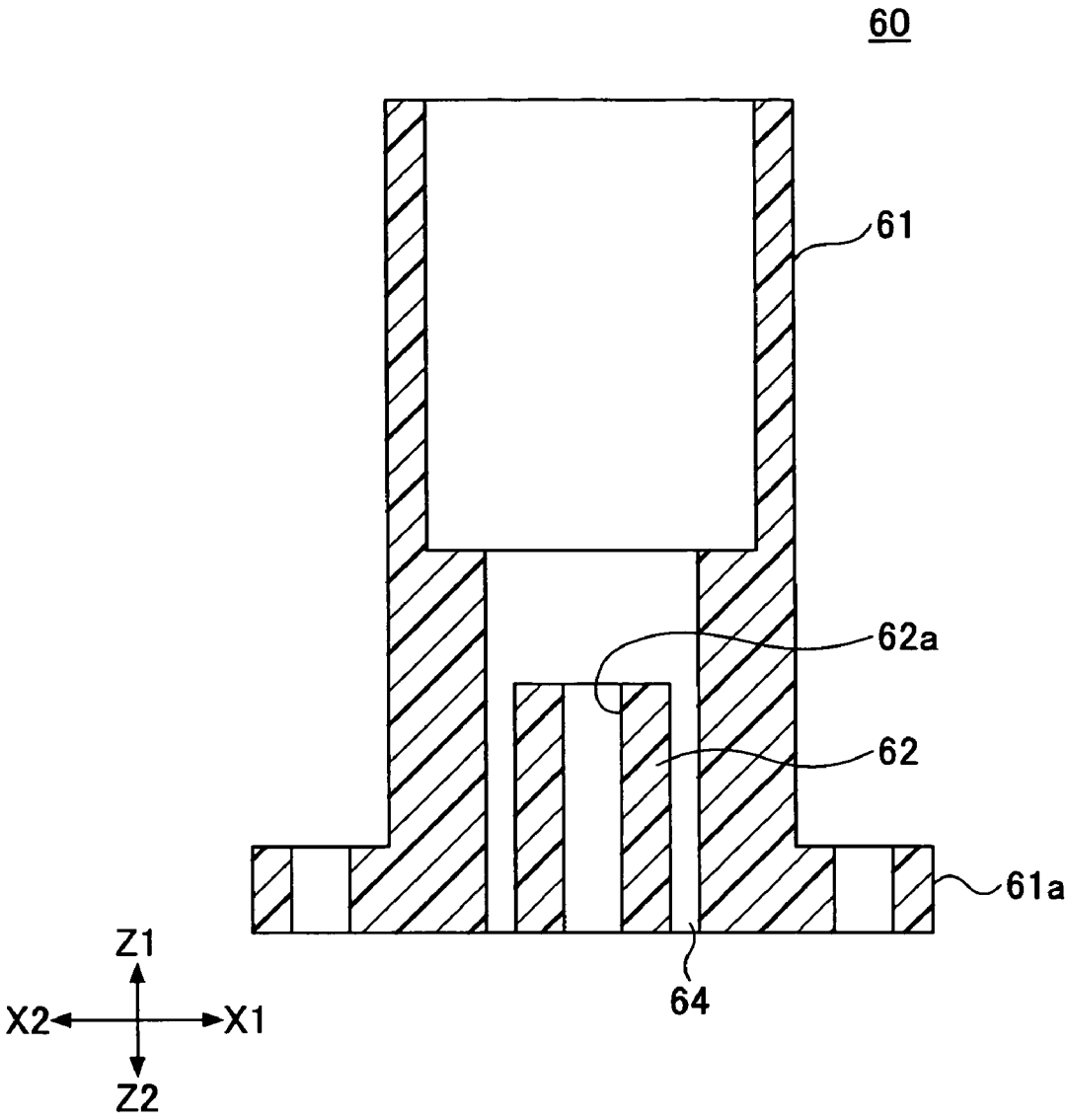
FIG. 9 shows a cross section SY of the housing of FIG. 3.

FIGS. 7 through 9 show the housing 60. FIG. 7 shows partial intersecting cross sections of the housing 60 of FIG. 3. FIG. 8 shows a cross section taken along the plane SX of FIG. 3. FIG. 9 shows a cross section taken along the plane SY of FIG. 3. The plane SX includes the lines X1-X2 and Z1-Z2. The plane SY is perpendicular to the plane SX and includes the lines Y1-Y2 and Z1-Z2.

The housing 60 shown in FIGS. 3, 7 through 9 is a molded component of synthetic resin, and it comprises a housing main body 61 and an insulator portion 62 that are integrally formed.

The housing main body 61 has the shape of an elliptic cylinder having a major axis in the X1-X2 direction and a minor axis in the X1-X2 direction. There is a flange portion 61*a* on the Z2 end, in which screw holes 61*b* are formed. From a side 61*c* on the Z2 end of the housing 60, two projections 61*d* protrude for positioning purposes.

The insulator portion 62 is disposed inside the housing main body 61 on the Z2 side. The insulator portion 62 is cylindrical in shape having a throughhole 62*a* at the center.

The insulator portion 62 and the housing main body 61 are coupled to each other via coupling portions 63Y1 and 63Y2 which are located on the internal circumferential surfaces of the housing main body 61. Specifically, the coupling portions 63Y1 and 63Y2 are located at Y1 and Y2 sides, respectively, on the circumferential surfaces of the insulator portion 62 at the Z1 end. The shape of a cross section of the coupling portion 63Y1 or 63Y2 along the internal peripheral surfaces of the housing main body 61 corresponds to the shape of a lower portion of the cutout portion 55Y1 or 55Y2 of the above described surrounding conductor 52.

Between the outer circumferential surface of the insulator portion 62 and the internal circumferential surface of the housing main body 61, there is a ring-shaped space 64. Because the housing main body 61 is an elliptical cylinder, the portions of the ring-shaped space 64 that are on the X1 and X2 sides each have a sufficient width to allow the passage of the contact portions 54X1 or 54X2. Indicated at 65Y1 and 65Y2 are slits on the Z2 side of the coupling portions 63Y1 and 63Y2, forming a part of the ring-shaped space 64.

The center conductor 51 is disposed to penetrate the throughhole 62*a* from the Z2 end of the housing in a fit manner.

The surrounding conductor 52 is mounted by fitting the contact portions 54X1 and 54X2 into the ring-shaped space 64 from the Z2 side toward Z1. Upon assembly, the contact portions 54X1 and 54X2 protrude beyond the ring-shaped space 64 into the housing main body 61, with the cylinder portion 53 fitted in the ring-shaped space 64 and the slits 65Y1 and 65Y2, and with the cutout portions 55Y1 and 55Y2 tightly fitted with the coupling portions 63Y1 and 63Y2, respectively. The fitting between the cutout portions 55Y1, 55Y2 and the coupling portions 63Y1, 63Y2 determines the position of the surrounding conductor 52 in the circumferential direction, such that the contact portions 54X1 and 54X2 are opposite to each other in the X1-X2 direction near the entrance of the housing main body 61 on the Z1 side.

As shown partially in FIG. 2, the above described leg portion 51*a* and lugs 56 are exposed on the surface 61*c* of the housing 60 on the Z2 end.

Circuit Board

As shown in FIG. 2, the circuit board 70 has a signal pad 71, a ground pad 72, positioning holes 73, and screw holes 74 that are formed where the coaxial connector 50 is mounted.

The signal pad 71 corresponds to the leg portion 51*a*, and is circular in shape. The ground pad 72 corresponds to the lugs 56 and is ring-shaped. The ground pad 72 is connected to a ground pattern (not shown). The signal pad 71 may be connected through a via to a signal pattern (not shown).

The positioning holes 73 and the screw holes 74 are formed outside the ring-shaped ground pad 72.

The circuit board 70 thus does not have the throughhole that is a cause of the degradation of signal transmission characteristics.

Surface Mounting of the Coaxial Connector

Figure 10:
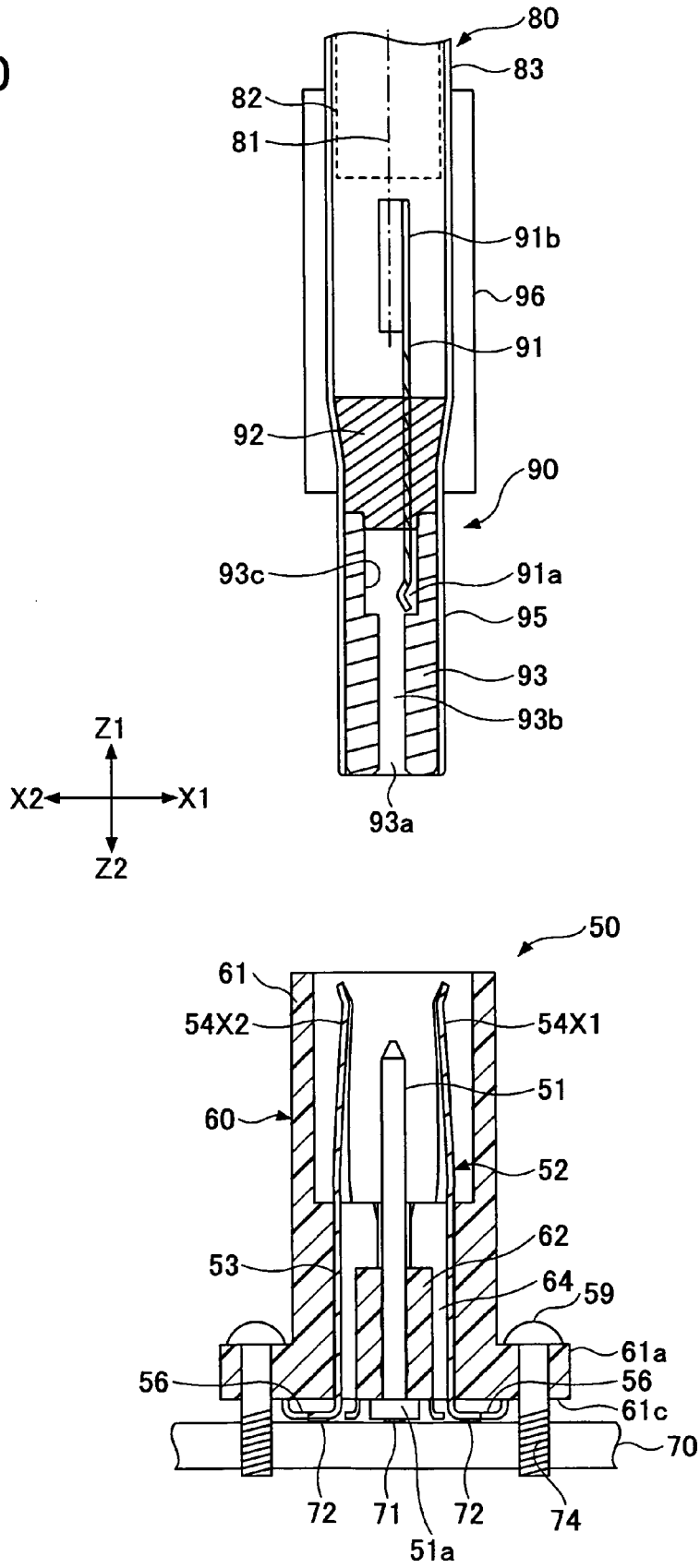
FIG. 10 shows a coaxial-cable-side coaxial connector (top) before it is connected to a mounted coaxial connector (bottom)

The coaxial connector 50 is mounted by threading the screws 59 into the holes 74 via the holes 61*b* while it is positioned by fitting the projections 61*d* into the positioning holes 73, thereby fixing the coaxial connector 50 vertically on the circuit board 70, as shown in FIG. 10.

With the screws 59 tightly fastened, the leg portion 51*a* is strongly pressed against the signal pad 71, while the six lugs 56 are strongly pressed against the ground pad 72 at the six locations indicated by broken-line circles P shown in FIG. 2. Thus, electrical connection is established between the center conductor 51 and the signal pad 71 and between the surrounding conductor 52 and the ground pad 72, the ground pad providing ground potential. The surface 61*c* on the Z2 end of the housing 60 is slightly spaced apart from the circuit board 70.

In particular, the lugs 56 are pressed against the ground pad 72 at the six locations that are spaced apart from each other at regular angular intervals, thereby ensuring reliable electrical connection between the surrounding conductor 52 and the ground pad 72.

There is no inductance-increasing soldered portion at the sites of electrical connection between the center conductor 51 and the signal pad 71 and between the surrounding conductor 52 and the ground pad 72. Furthermore, the circuit board 70 does not have the throughhole where the coaxial connector 50 is mounted. Thus, the coaxial connector 50 can be mounted on the circuit board 70 without suffering from any degradation in its characteristics. Specifically, the coaxial connector 50 thus mounted can maintain its characteristic impedance of 50Ω and be adapted to the transmission of high frequency signals of several 10 GHz or above.

Figure 11:
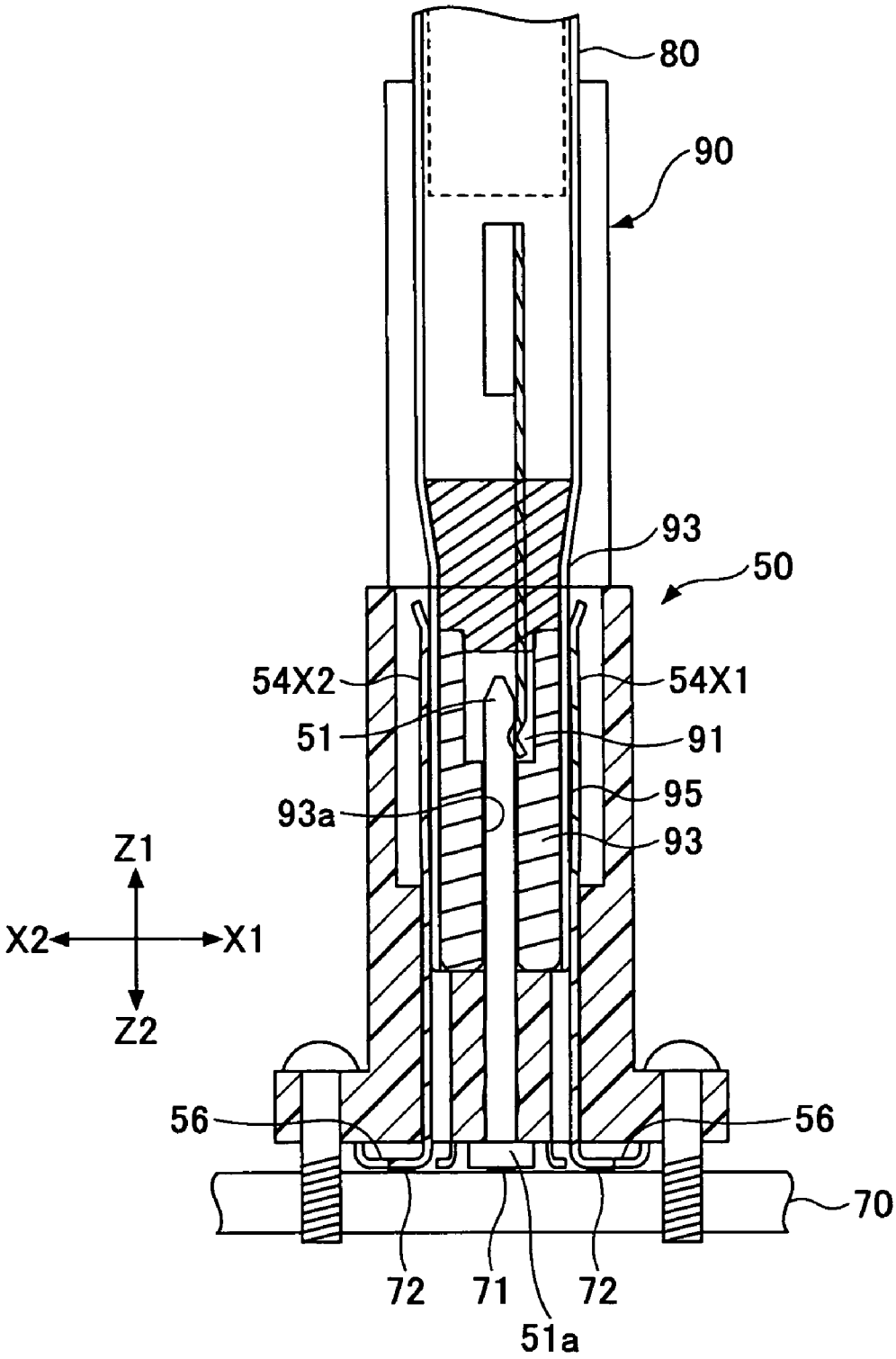
FIG. 11 shows the coaxial-cable-side coaxial connector connected to the mounted coaxial connector.

Into the coaxial connector 50 thus mounted, a coaxial-cable-side coaxial connector 90 attached to the end of a coaxial cable 80 is inserted and connected therewith, as shown in FIG. 11.

FIG. 10 shows the coaxial-cable-side coaxial connector 90, which is columnar in shape and of the female type. It comprises an insulator 92 in which a center conductor 91 is insert-molded; an insulator 93 on the tip end (Z2 end) of the insulator 92; a cylindrical surrounding conductor 95 surrounding the insulator 92 and the tip-end insulator 93; and a housing 96 surrounding the surrounding conductor 95.

The tip-side insulator 93 has a stepped throughhole 93*a*, which consists of a tip-side throughhole 93*b* and a back-side (Z1 end) throughhole 93*c*. The tip-side throughhole 93*b* has a diameter that corresponds to the diameter of the center conductor 51. The back-side throughhole 93*c* has a diameter that is about twice the diameter of the tip-side throughhole 93*b*. The center conductor 91 has a contact portion 91*a* that protrudes from the insulator 92 toward the tip side, and a crimping portion 91*b* protruding out of the insulator 92 toward the back side. The contact portion 91*a* protrudes into the throughhole 93*c*.

Still referring to FIG. 10, the coaxial-cable-side coaxial connector 90 is attached to a processed end of the coaxial cable 80. The inner conductor 81 of the coaxial cable 80 is crimped by the crimping portion 91*b*, while an outer conductor 82 of the coaxial cable 80 is crimped inside the surrounding conductor 95 of the connector 90. The housing 96 covers a sheath 83 of the coaxial cable 80.

As shown in FIG. 11, the coaxial-cable-side coaxial connector 90 is inserted into the mounted coaxial connector 50 and connected therewith. The center conductor 51 relatively penetrates the throughhole 93*b* so that its tip-side portion enters into the throughhole 93*c*, with the contact portion 91*a* contacting the tip-side portion of the center conductor 51. The surrounding conductor 95 is sandwiched between the pair of contact portions 54X1 and 54X2 and thus in contact therewith.

Since the coaxial connector 50 is mounted on the circuit board 70 without having its characteristics degraded at all, high frequency signals of even several 10 GHz or above can be transmitted between the coaxial cable 80 and the circuit board 70 via the coaxial-cable-side coaxial connector 90 and the coaxial connector 50.

Figure 12:
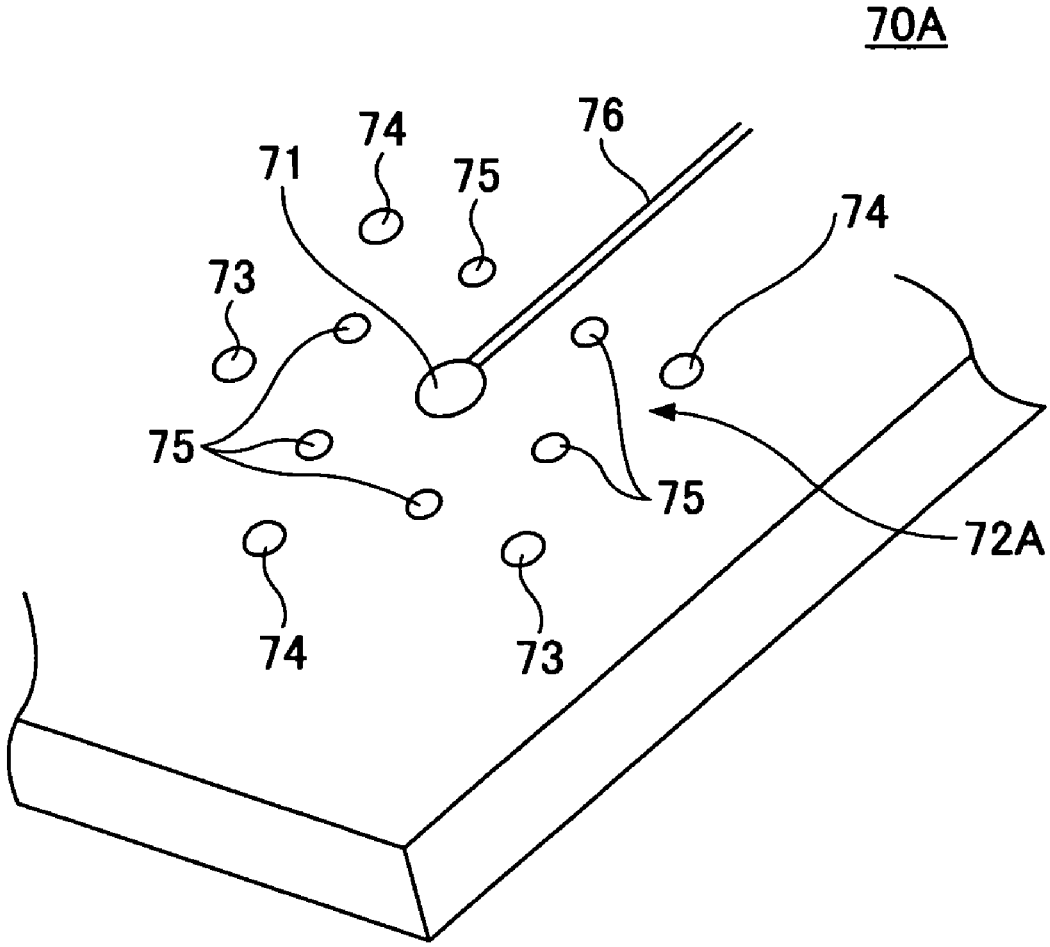
FIG. 12 shows a portion of a circuit board where a coaxial connector is to be mounted according to a variation of the embodiment of FIG. 2.

FIG. 12 shows a circuit board 70A according to a variation of the foregoing embodiment, showing an area where the coaxial connector 50 is mounted. In this variation, a ground pad 72A consists of six circular pads 75 that are disposed at regular angular intervals. A signal pattern 76 is formed on the upper surface of the circuit board 70A, extending from the signal pad 71 between adjacent circular pads without vias.

In a preferred embodiment, the coaxial connector 50 may be configured as a female connector by providing the center conductor 51 with a central depression.

Embodiment 2

Figure 13:
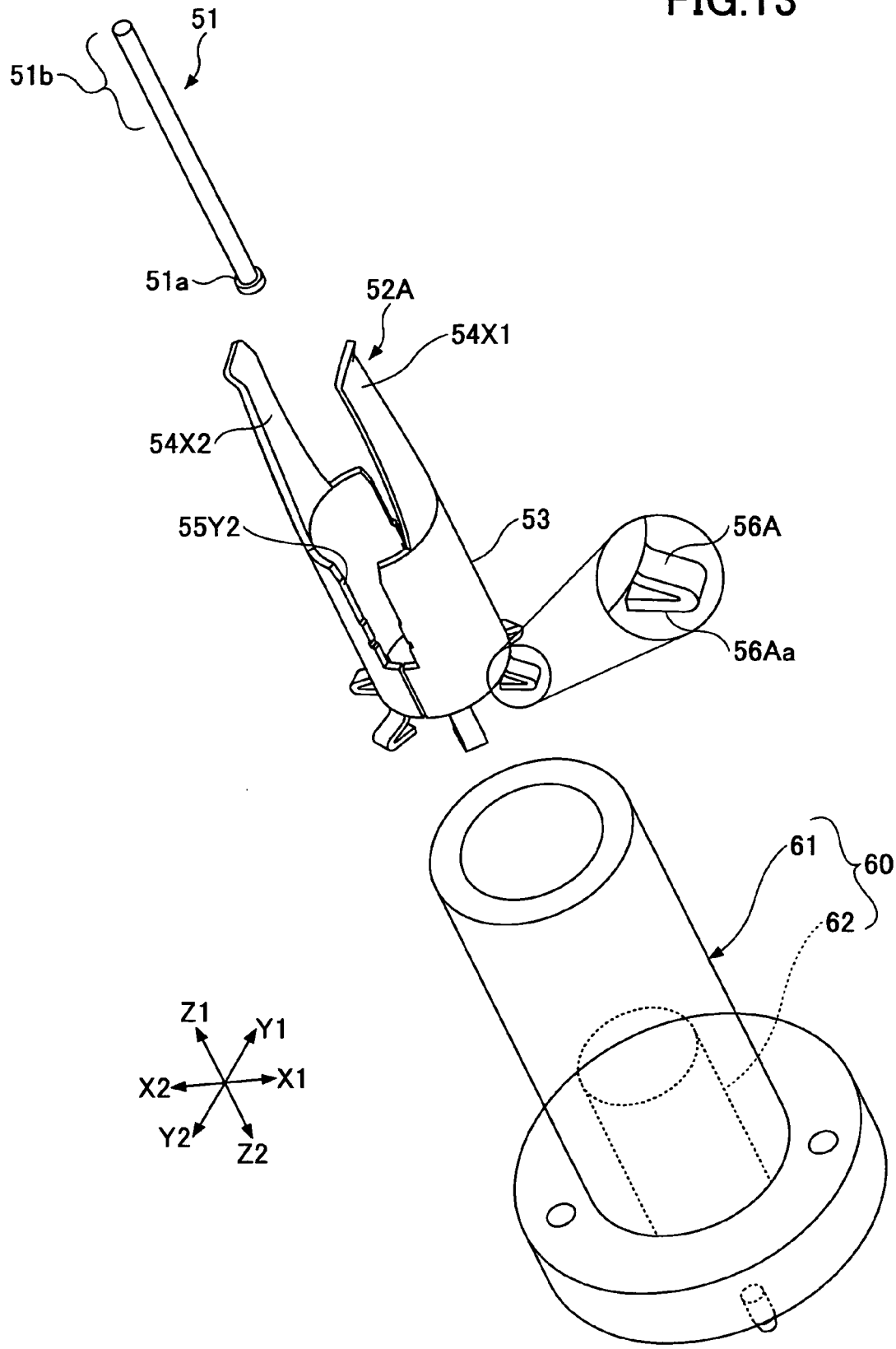
FIG. 13 shows an exploded perspective view of a coaxial connector according to another embodiment of the present invention.

FIG. 13 shows a coaxial connector 50A according to a second embodiment of the invention, which is similar to the coaxial connector shown in FIGS. 2 and 3 with the exception of a surrounding conductor 52A.

The surrounding conductor 52A is similar to the corresponding conductor shown in FIG. 3 except for lugs 56A. Specifically, the tip of each of the lugs 56A, which are radially disposed, is bent by 180° toward the center of the surrounding conductor 52A, thus providing the lugs with a spring property. Numeral 56Aa indicates the bent portion.

The spring property of the lugs 56A absorbs dimensional variations in the way the multiple lugs are arranged, for example, so that enhanced reliability can be achieved in electrical connection between the lugs 56A and the ground pad 72(72A) compared with the structure of FIG. 10.

Embodiment 3

Figure 14:
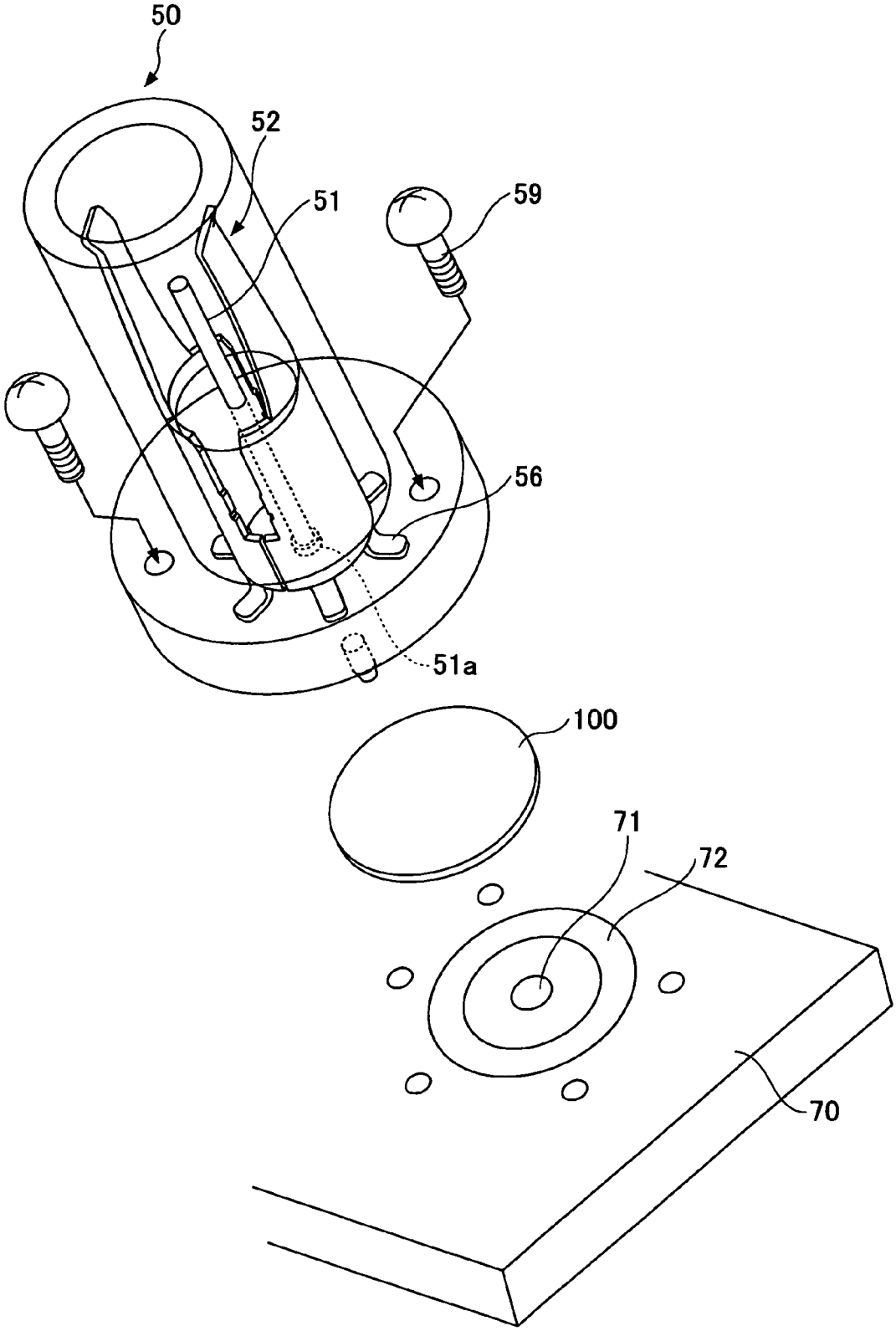
FIG. 14 is an exploded view of a variation of the structure for mounting the coaxial connector on the circuit board shown in FIG. 2.
Figure 15:
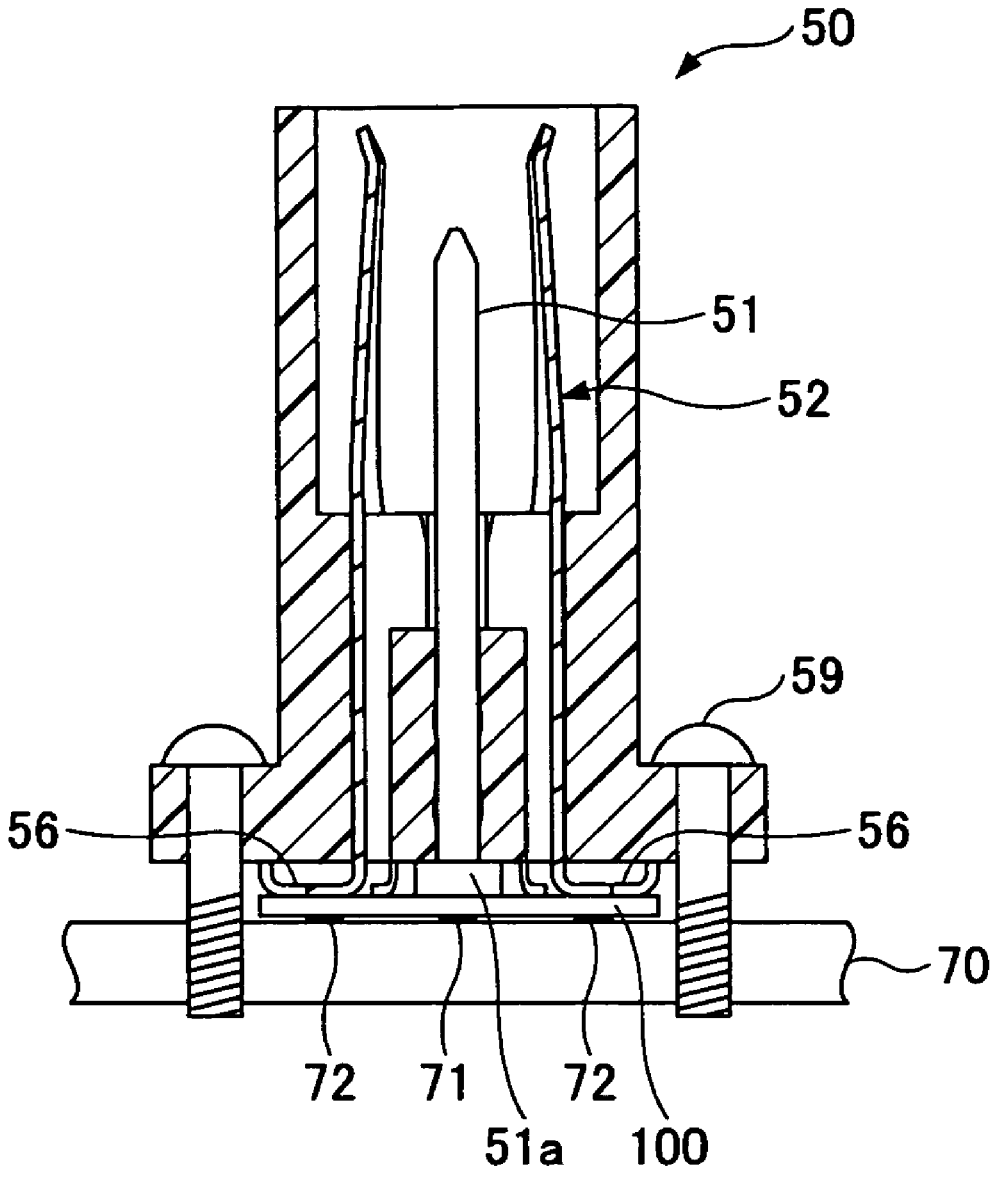
FIG. 15 shows a cross section of the mounting structure of FIG. 14.

FIGS. 14 and 15 show a first variation of the mounting structure of the coaxial connector 50 on the circuit board 70 described above.

Numeral 100 indicates a sheet-shaped conductive spacer which exhibits electrical conductivity where compressed in the thickness direction.

The coaxial connector 50 is mounted on the circuit board 70 via the conductive spacer 100. The leg portion 51*a* and the lugs 56 are strongly pressed against the conductive spacer 100, thus compressing the corresponding portions. The leg portion 51*a* is electrically connected with the signal pad 71 via the portion of the conductive spacer 100 that is compressed by the leg portion 51*a*. The six lugs 56 are electrically connected with the ground pad 72 via the portions of the conductive spacer 100 that are compressed by the lugs 56, providing ground potential.

The presence of the conductive spacer 100 eliminates variations in height between the leg portion 51*a* and the lugs 56 and among the lugs 56, for example. Thus, improved reliability can be achieved in electrical connection between the leg portion 51*a* and the signal pad 71 and between the six lugs 56 and the ground pad 72 compared with the structure of FIG. 10.

The inductance of the conductive spacer 100 is so small that the coaxial connector 50 can be mounted on the circuit board 70 with hardly any degradation in its characteristics.

In a preferable embodiment, the coaxial connector 50 may be fitted with the conductive spacer 100 on its bottom surface in advance.

Embodiment 4

Figure 16:
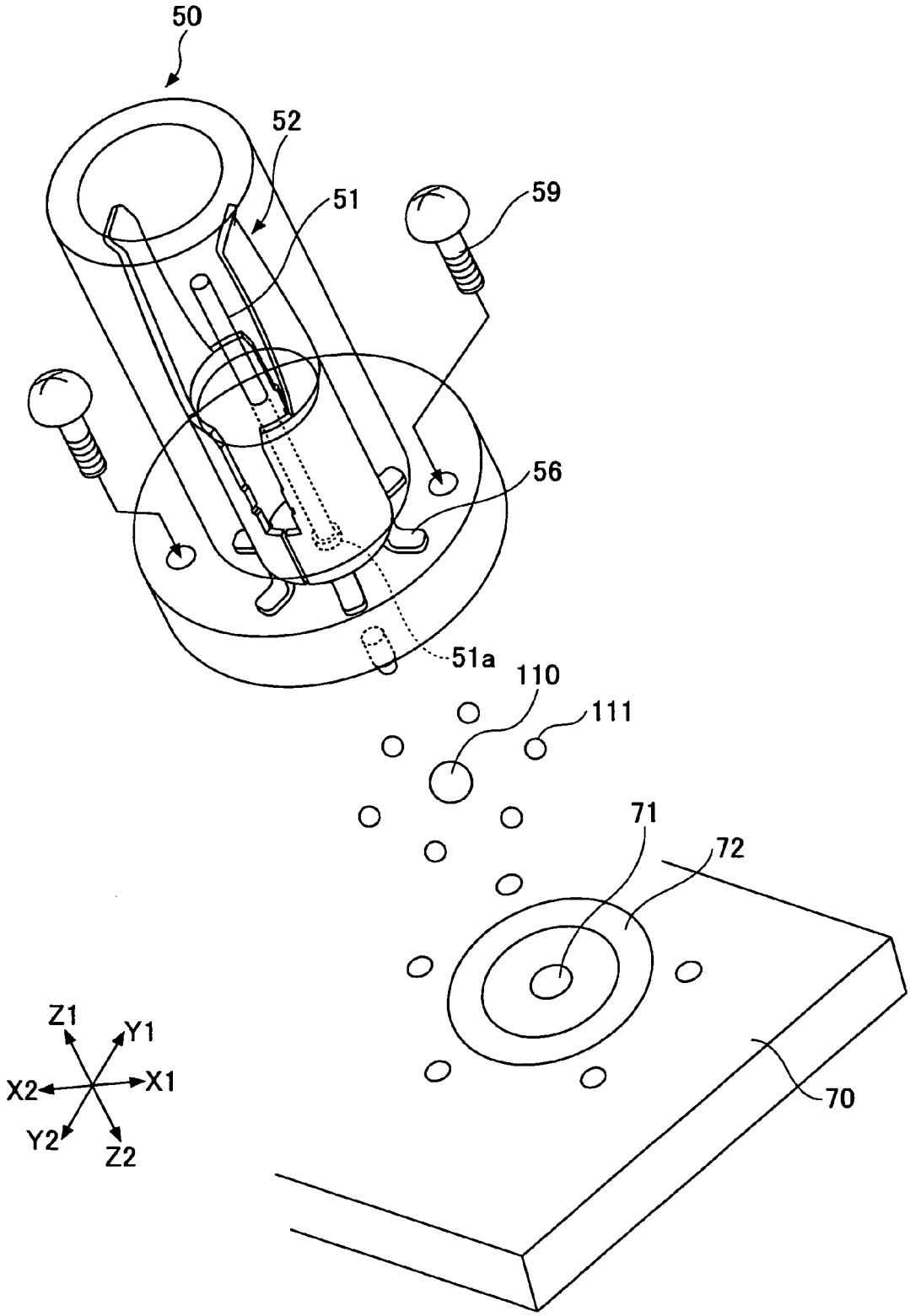
FIG. 16 is an exploded view of another variation of the structure for mounting the coaxial connector on the circuit board shown in FIG. 2.
Figure 17:
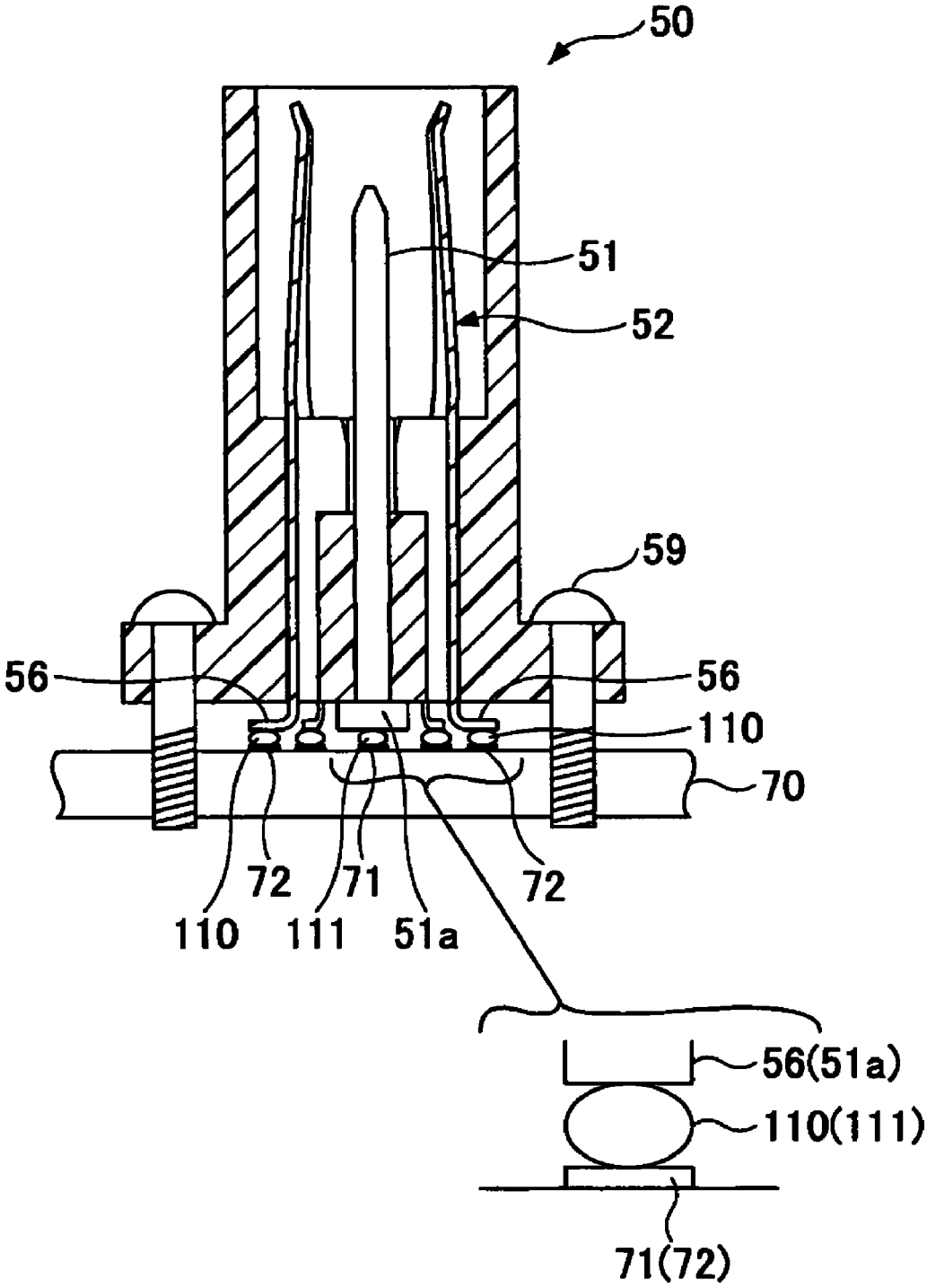
FIG. 17 shows a cross section of the mounting structure of FIG. 16.

FIGS. 16 and 17 show a second variation of the mounting structure of the coaxial connector 50 on the circuit board 70 described above.

In the second variation, instead of the above conductive spacer 100, plural conductive balls 110 and 111 are used. The conductive balls 110 and 111, which may be made of silver, have electrical conductivity and elasticity. They are spherical in shape with dimensions corresponding to those of the leg portion 51*a* and the lugs 56; i.e., their diameter is on the order of 0.3 mm.

The coaxial connector 50 is mounted on the circuit board 70 via the conductive ball 110 as regards the leg portion 51*a* and via the conductive balls 111 as regards the individual lugs 56. The conductive balls 110 and 111 are both placed under an elastically deformed state in the crushed direction; i.e., they have an elastic force in the recovering direction. Due to this elastic force, the conductive ball 110 is pressed against the leg portion 51*a* and the signal pad 71, thereby providing electrical connection between them. Similarly, the conductive balls 111, due to their elastic force, are pressed against the lugs 56 and the ground pad 72, so that all of the lugs 56 are electrically connected with the ground pad 72 via the conductive balls 111.

In this way, the influence of any variations in height between the leg portion 51*a* and the lugs 56 and among the lugs 56 can be eliminated. As a result, enhanced reliability can be achieved in electrical connection between the leg portion 51*a* and the signal pad 71 and between the six lugs 56 and the ground pad 72, compared with the structure of FIG. 10.

The inductance of the conductive balls 110 and 111 is so small that the coaxial connector 50 can be mounted on the circuit board 70 with hardly any degradation in its characteristics.

In a preferred embodiment, the coaxial connector 50 may be fitted with the conductive ball 110 on the bottom surface of the leg portion 51*a* and with the conductive balls 111 on the bottom surface of the individual lugs 56 in advance.

The conductive ball 110 and the conductive balls 111 may be identical.

Embodiment 5

Figure 18:
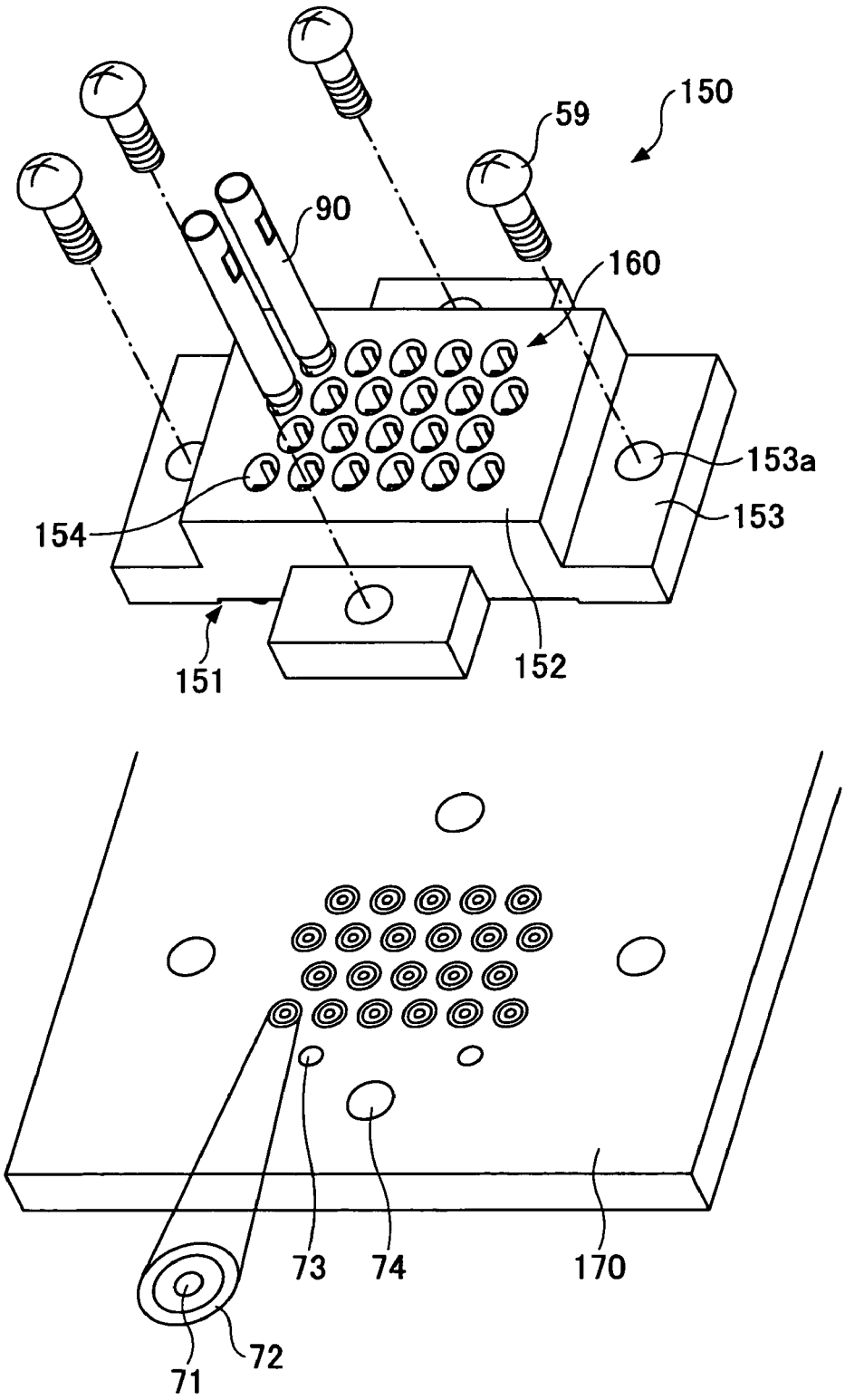
FIG. 18 shows a perspective view of a coaxial connector according to another embodiment of the invention, shown together with a circuit board on which it is mounted.
Figure 19:
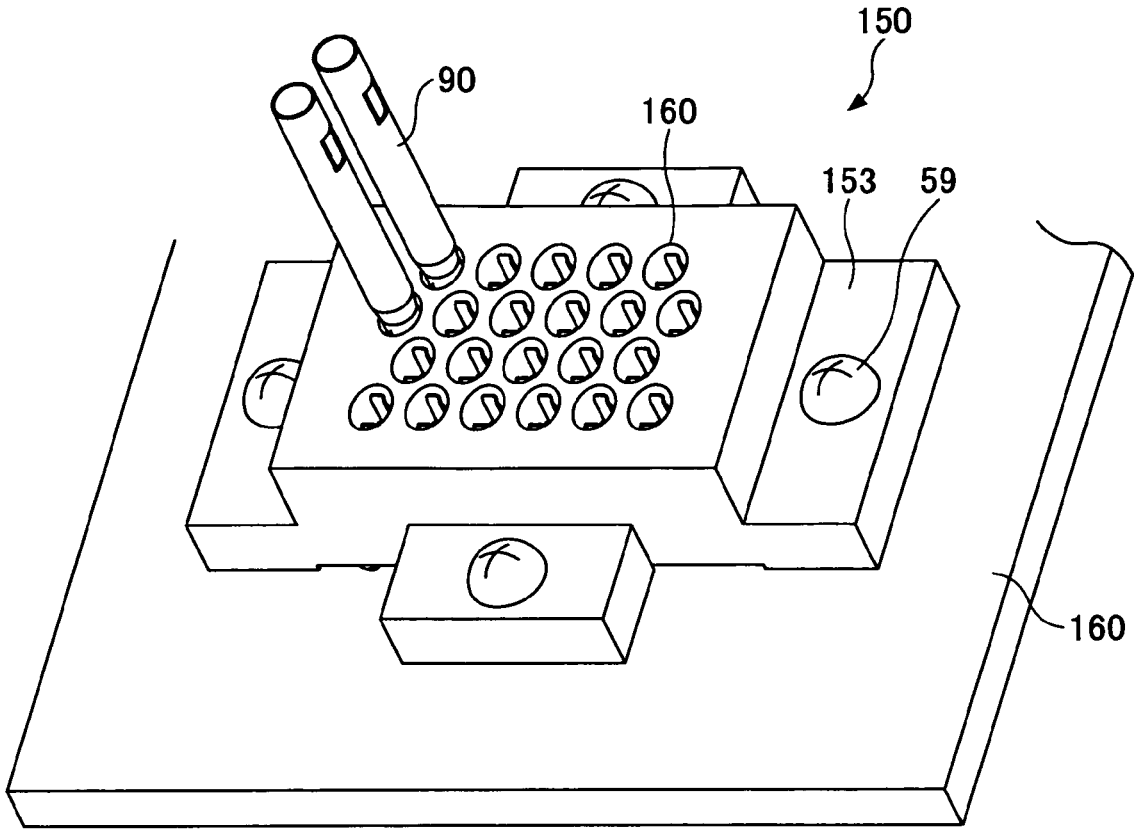
FIG. 19 shows a perspective view of the coaxial connector of FIG. 18 mounted on the circuit board.
Figure 20:
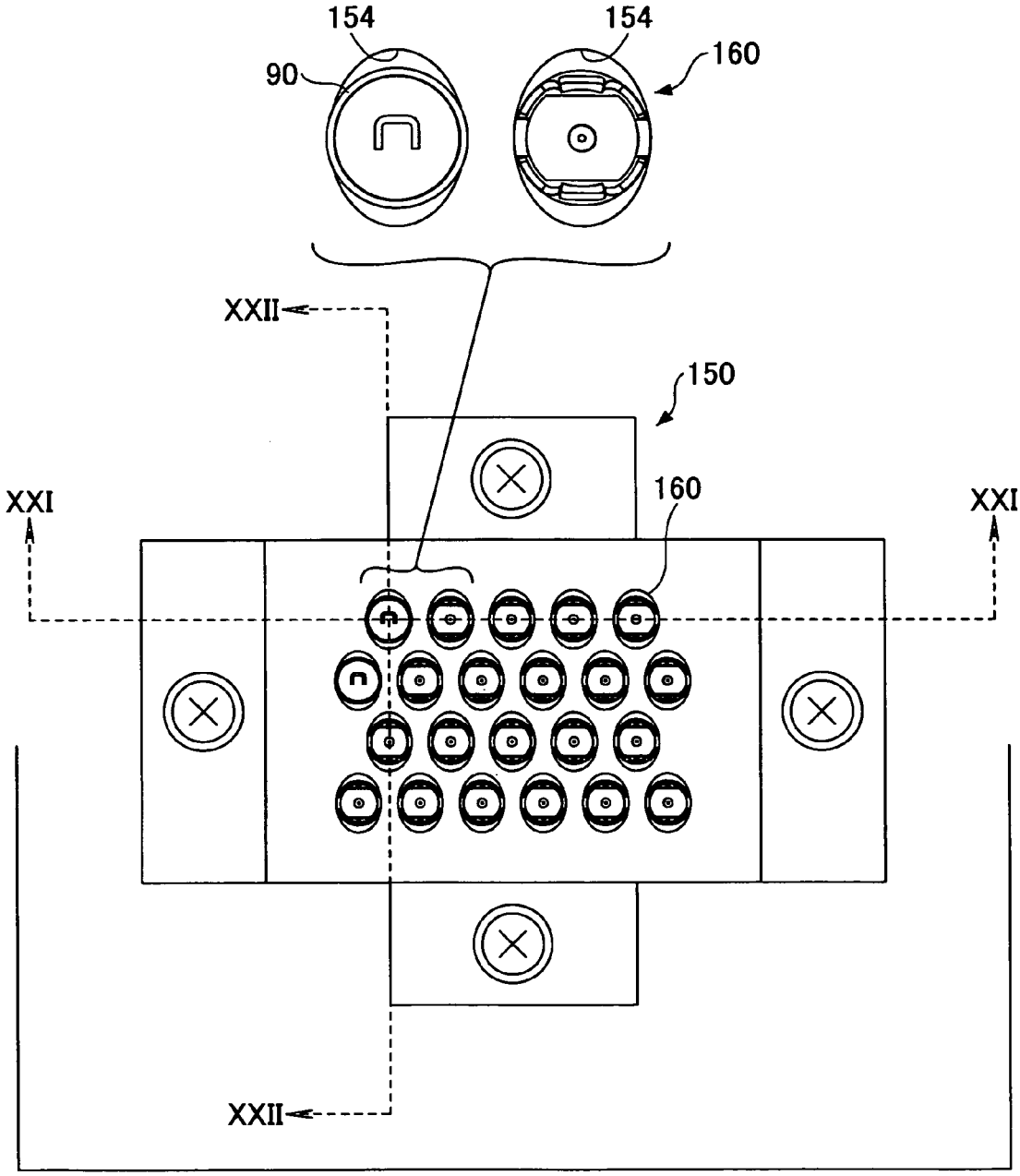
FIG. 20 is a plan view of the coaxial connector of FIG. 19.
Figure 21:
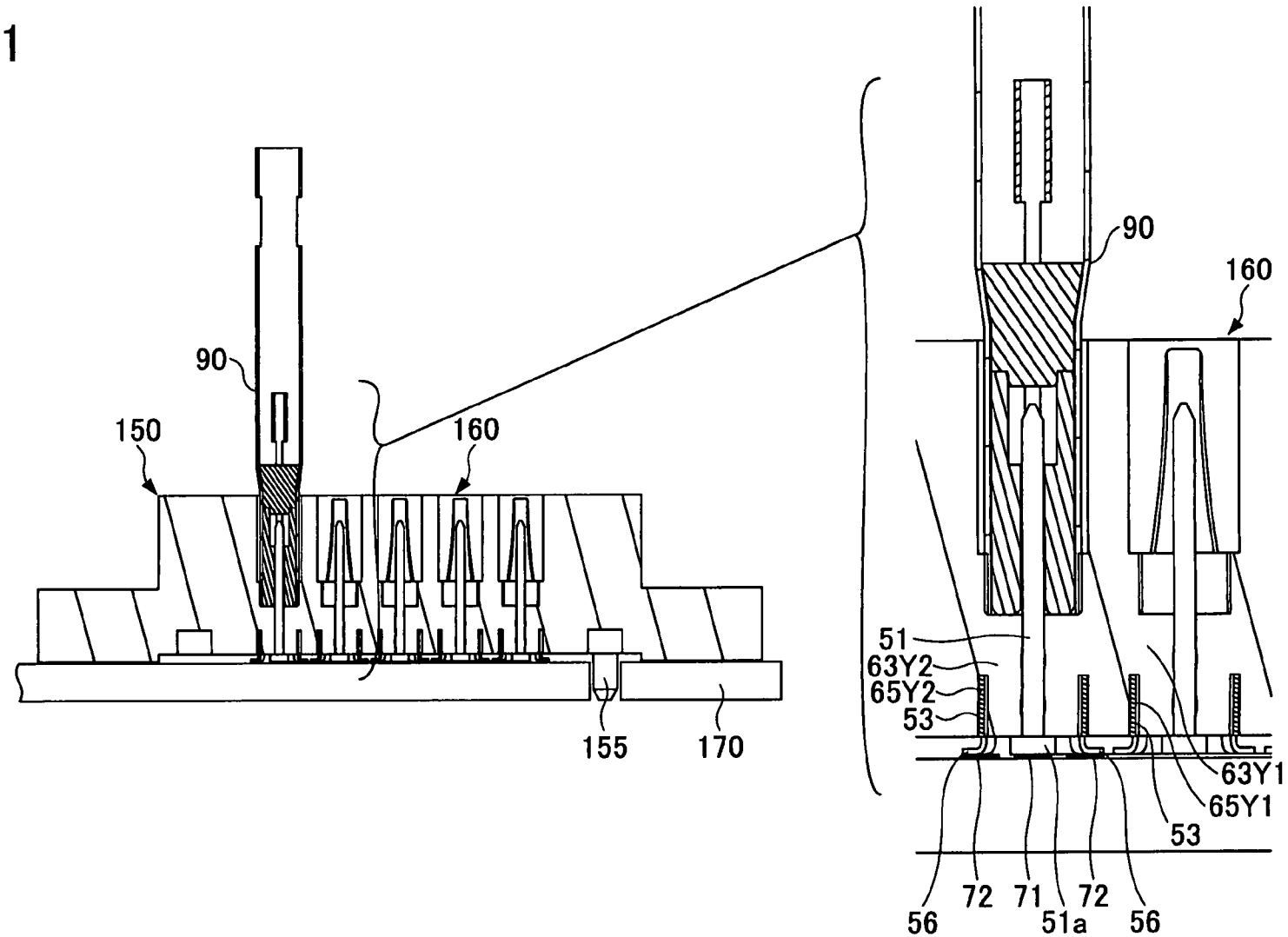
FIG. 21 is a cross section taken along line XXI-XXI shown in FIG. 20.
Figure 22:
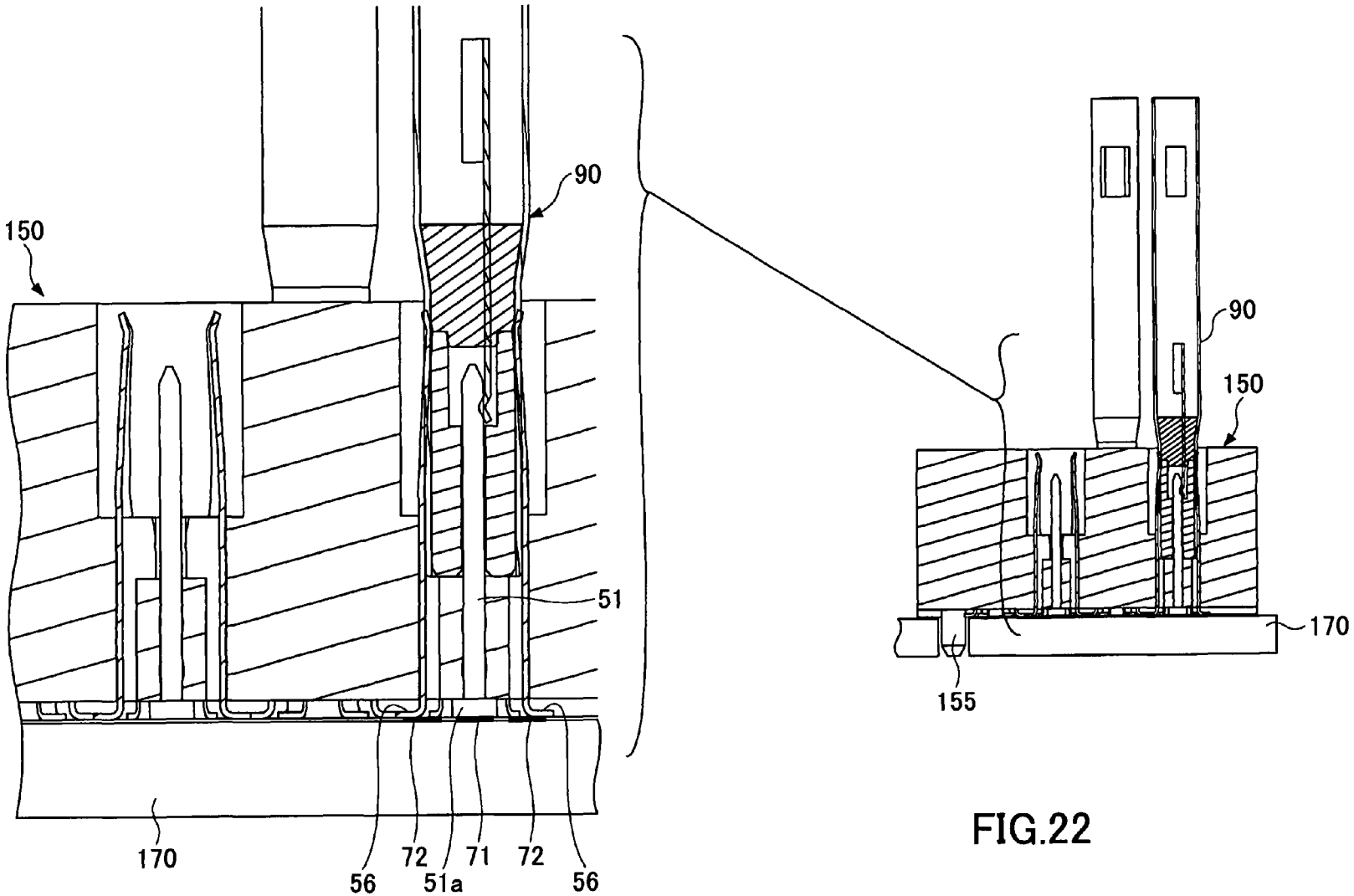
FIG. 22 is a cross section taken along line XXII-XXII shown in FIG. 20.

FIG. 18 shows a coaxial connector 150 according to a fifth embodiment of the invention, together with a circuit board 170 on which it is to be mounted. FIG. 19 shows the coaxial connector 150 mounted on the circuit board 170. FIG. 20 shows a plan view of the coaxial connector 150. FIG. 21 shows a cross section taken along line XXI-XXI of FIG. 20. FIG. 22 shows a cross section taken along line XXII-XXII of FIG. 20.

The coaxial connector 150 comprises plural coaxial connector portions 160, each having substantially the same structure as the coaxial connector 50 shown in FIG. 2, arranged in a matrix. Numeral 151 indicates a housing that is a plate-like molded component of synthetic resin, consisting of a rectangular and plate-like main body portion 152 and flange portions 153 extending from the main body portion 152 in four directions. The main body portion 152 has holes 154 having an elliptical cross section arranged in a matrix. In each of the holes 154, the above-described insulator portion 62 is formed integrally with the main body portion 152.

Each of the flange portions 153 has a screw hole 153*a* formed therein. From the bottom surface of the main body portion 152, projections 155 for determining the mounting position protrude.

Into each of the holes 154 in the main body portion 152, the center conductor 51 and the surrounding conductor 52 are inserted from the bottom surface of the main body portion 152 and assembled therein in the same manner as the coaxial connector 50, thereby forming the coaxial connector portion 160.

On the bottom surface of the coaxial connector 150, a number of units consisting of a leg portion and surrounding six lugs are arranged in a matrix.

As shown in FIG. 18, on the circuit board 170, a number of units consisting of the signal pad 71 and the ground pad 72 are arranged in the same way as the coaxial connector portions 160.

In the circuit board 170, positioning holes 73 and screw holes 74 are formed.

As shown in FIGS. 19 through 22, the coaxial connector 150 is mounted and fixed on the circuit board 170 by fitting projections 155 in the positioning holes 73 for positioning purposes and then threading the screws 59 into the holes 74 via the holes 153*a*.

With the screws 59 tightly fastened, the leg portion 51*a* of each of the coaxial connector portions 160 is strongly pressed against the signal pad 71, while the six lugs 56 are strongly pressed against the ground pads 72, as shown enlarged in FIGS. 21 and 22. Thus, the center conductor 51 is electrically connected to the signal pad 71 and the surrounding conductor 52 is electrically connected to the ground pad 72, the latter providing ground potential.

Since there is no inductance-increasing soldered portion at the site of electrical connection between the center conductor 51 and the signal pad 71 and at the site of electrical connection between the surrounding conductor 52 and the ground pad 72, the coaxial connector 150 is mounted on the circuit board 170 without any degradation in the characteristics of any of the coaxial connector portions 160. Thus, each of the coaxial connector portions 160 can maintain its characteristic impedance of 50Ω and be adapted to the transmission of high frequency signals of several 10 GHz or above.

Into each of the coaxial connector portions 160 in the thus mounted coaxial connector 150, a coaxial-cable-side coaxial connector 90 at the end of a coaxial cable 80 is inserted and connected therewith, as shown in FIGS. 20 through 22.

In a preferred embodiment, the coaxial connector 150 may be mounted with a conductive spacer disposed between it and the circuit board, as shown in FIGS. 14 and 15. Furthermore, it is also possible to mount the coaxial connector 150 with conductive balls disposed between it and the circuit board, as shown in FIGS. 16 and 17. By thus interposing a conductive spacer or conductive balls, enhanced reliability in electrical connection can be achieved between the coaxial connector 150 and the circuit board 170.

Embodiment 6

Figure 29:
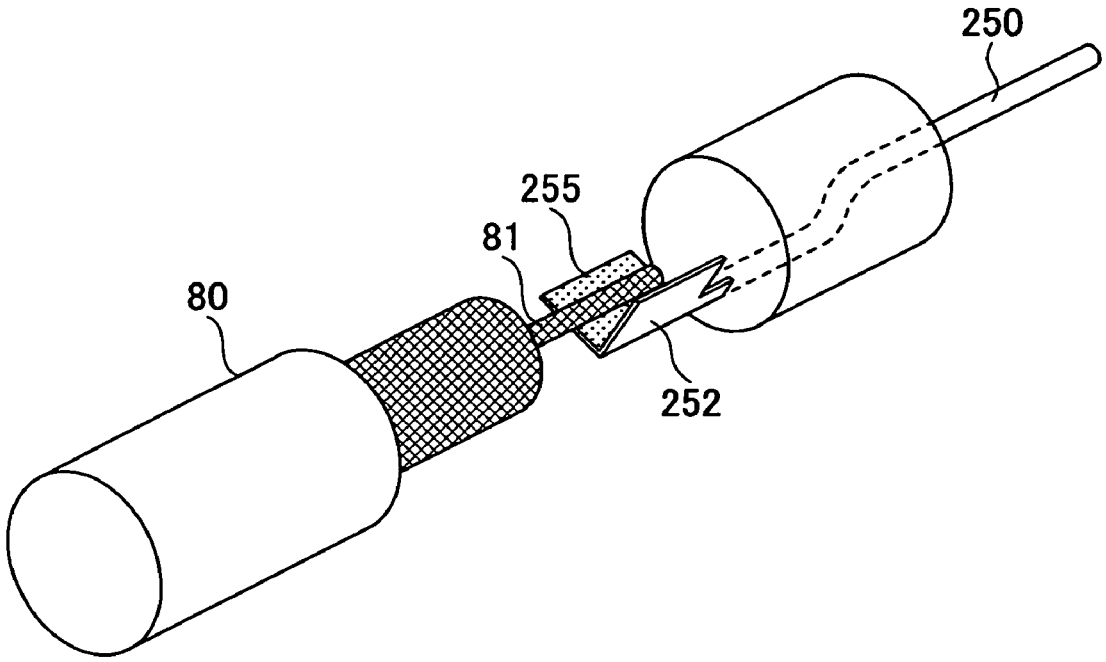
FIG. 29 shows a part of a conventional coaxial-cable-side coaxial connector.

Conventionally, as shown in FIG. 29, a processed tip of the inner conductor 81 of the coaxial cable 80 is soldered to a connecting portion 252 formed at the back-end of the central pin terminal 250, and the end is surrounded by a cylindrical outer conductor that is crimped. Thus, the connection requires both soldering and crimping steps. Numeral 255 indicates solder.

Figure 23:
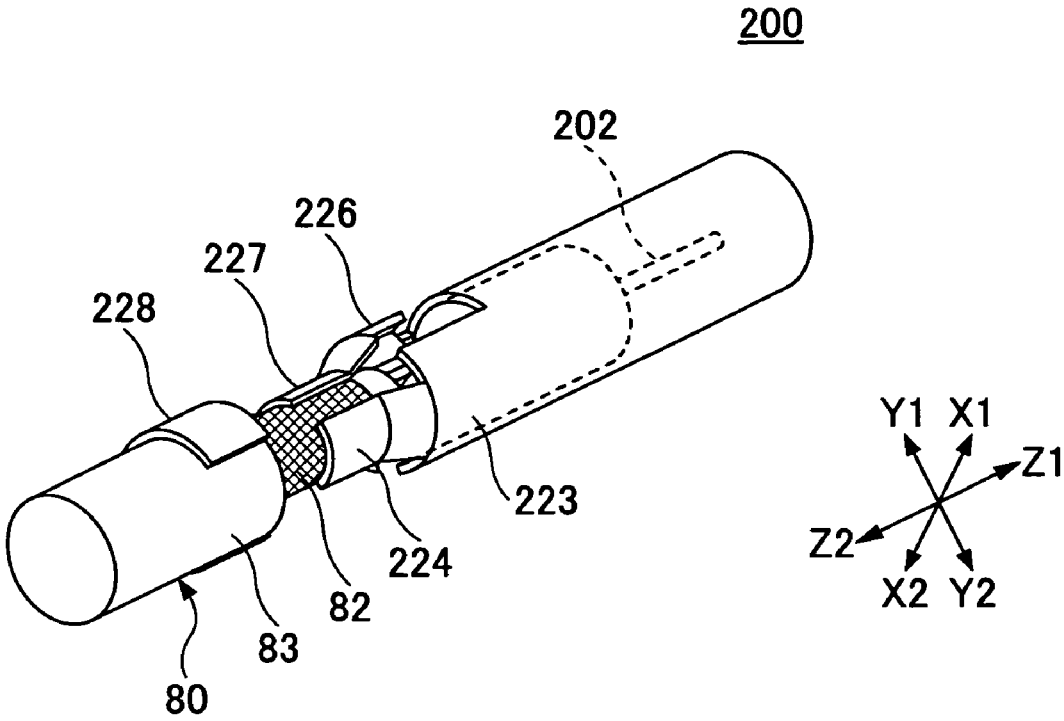
FIG. 23 is a perspective view of a coaxial-cable-side coaxial connector according to another embodiment of the invention.
Figure 24B:
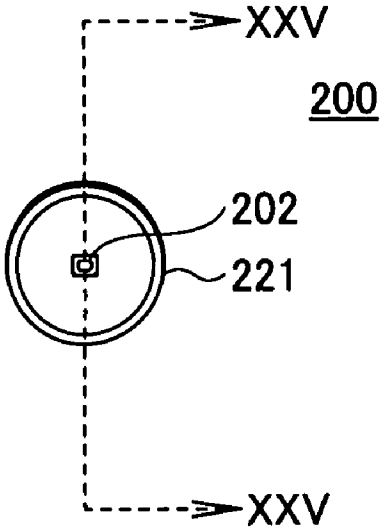
FIG. 24B is a plan view of the coaxial-cable-side coaxial connector of FIG. 23.
Figure 24A:
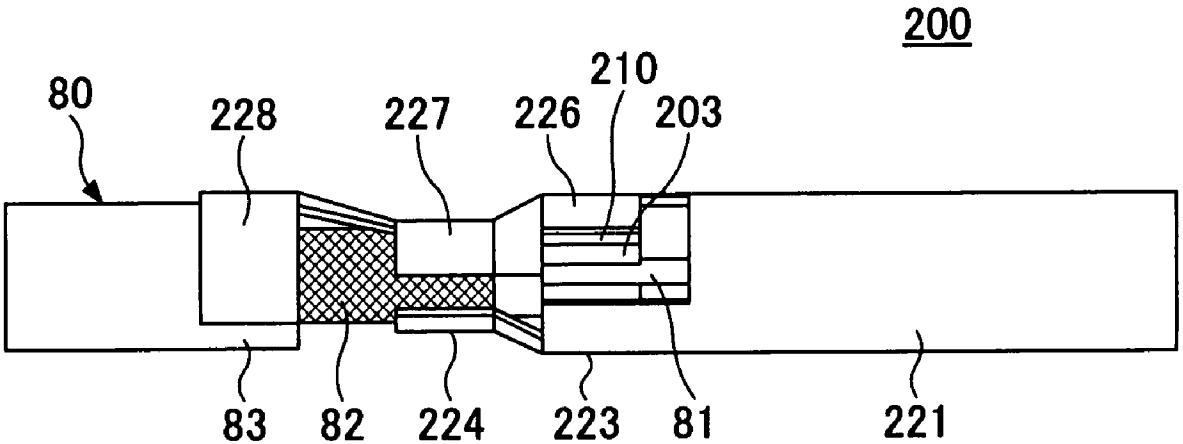
FIG. 24A is a lateral view of the coaxial-cable-side coaxial connector of FIG. 23.
Figure 25:
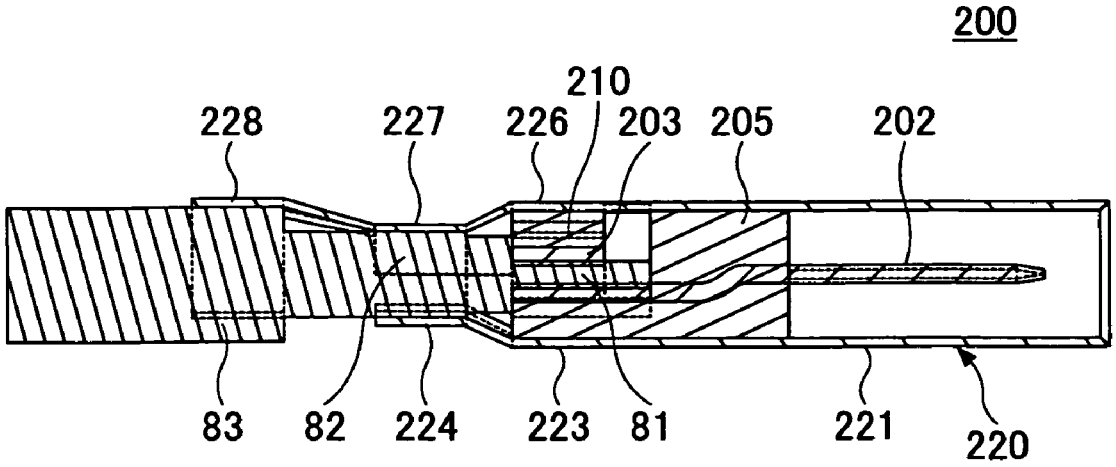
FIG. 25 shows a cross section taken along line XXV-XXV of FIG. 24B.
Figure 26:
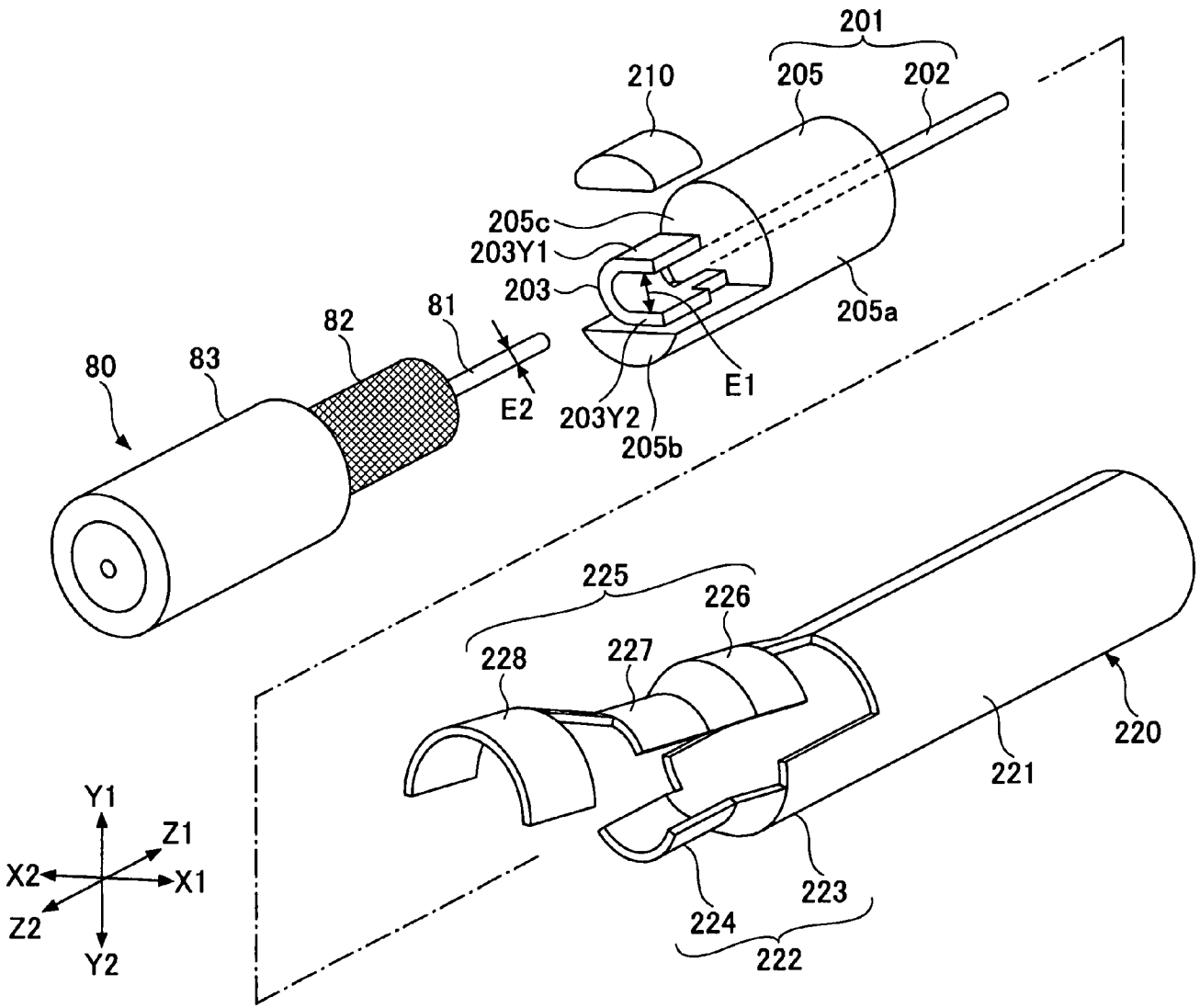
FIG. 26 shows an exploded perspective view of the coaxial-cable-side coaxial connector.

FIGS. 23 through 26 show a coaxial-cable-side coaxial connector 200 according to a sixth embodiment of the invention. FIG. 23 shows a perspective view of the coaxial-cable-side coaxial connector 200. FIG. 24A shows a lateral view of the coaxial-cable-side coaxial connector 200. FIG. 24B shows a plan view. FIG. 25 shows a cross section taken along line XXV-XXV of FIG. 24B. FIG. 26 is a exploded perspective view of the coaxial-cable-side coaxial connector 200, prior to crimping the outer conductor. Z1-Z2 indicates the direction of axis of the coaxial-cable-side coaxial connector 200. Y1-Y2 and X1-X2 indicate directions perpendicular to Z1-Z2 as well as to each other. Y1-Y2 is the direction of crimping, as will be described in detail below.

The coaxial-cable-side coaxial connector 200 is a male coaxial connector attached to the end of the coaxial cable 80. As shown exploded in FIG. 26, it comprises a center conductor terminal module 201, an interposed member 210, and a surrounding conductor 220.

The center conductor terminal module 201 has a center conductor terminal 202 insert-molded in a support member 205. The support member 205 is a molded component of insulating synthetic resin, and comprises a cylinder portion 205*a* and a substantially hemispherical jutted-out base portion 205*b*. The jutted out base portion 205*b* extends out in the Z2 direction from a Y2-side half of an end surface 205*c* on the Z2-end side of the cylinder portion 205*a*. The inner conductor terminal 202 has a connecting portion 203 on the Z2 side. The center conductor terminal 202 penetrates the cylinder portion 205*a* in the Z1-Z2 direction. The connecting portion 203 is disposed on the Y1-side surface of the jutted-out base portion 205*b*. The connecting portion 203 is U-shaped as seen from the Z2 end, and it has a planar portion 203Y2 on the Y2 side and another planar portion 203Y1 on the Y1 side. The gap between the planar portion 203Y2 and the planar portion 203Y1 has an interval E which is greater than the diameter E2 of the inner conductor 81 of the coaxial cable 80.

The interposed member 210 comprises a small molded component of insulating synthetic resin and is disposed on the planar portion 203Y1.

The surrounding conductor 220 comprises a metal-plate press-molded component that has a cylinder portion 221 on the Z1 end. From a Y2 side on the Z2 end of the cylinder portion 221, a first arm portion 222 extends in the Z2 direction. Similarly, from a Y1 side of the Z2 end of the cylinder portion 221, a second arm portion 225 extends in the Z2 direction.

The first arm portion 222 has a first portion 223 and a second portion 224.

The second arm portion 225 has a first portion 226, a second portion 227, and a third portion 228.

The first portion 223 on the Y2 side and the first portion 226 on the Y1 side are opposite to each other in the Y1-Y2 direction. The second portion 224 on the Y2 side and the second portion 227 on the Y1 side are opposite to each other in the Y1-Y2 direction.

The coaxial-cable-side coaxial connector 200 is assembled by the following steps.

(1) The center conductor terminal module 201 is placed inside the cylinder portion 221, such that, as shown in FIGS. 27A and 27B, the jutted-out portion 205*b* is positioned over the first portion 223 on the Y2 side.

(2) The interposed member 210 is disposed between the planar portion 203Y1 and the second portion 227 on the Y1 side, as shown in FIGS. 27A and 27B.

(3) The processed tip of the coaxial cable 80 is set. Specifically, the coaxial cable 80 is inserted into the outer conductor 220 from the Z2 end until the tip of the inner conductor 81 abuts the end surface 205*c* of the cylinder portion 205*a*. Then, as shown in FIGS. 27A and 27B, the inner conductor 81 is disposed between the planar portion 203Y2 on the Y2 side and the planar portion 203Y1 on the Y1 side of the connecting portion 203. Also, as shown in FIGS. 27A and 27C, the outer conductor 82 of the coaxial cable 80 is positioned between the second portion 224 on the Y2 side and the second portion 227 on the Y1 side. The third portion 228 on the Y1 side is located opposite the sheath 83 of the coaxial cable 80, as shown in FIG. 27A.

(4) Finally, a one-shot crimping is performed. Specifically, as shown in FIG. 27A, the surrounding conductor 220, together with the coaxial cable 80, is set on a fixed crimping-base portion 251 of a crimping device 250, and then an upper movable crimping-based portion 251 is lowered.

Figure 28C:
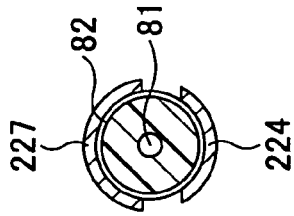
FIG. 28C shows a cross section taken along line C-C of FIG. 28A.
Figure 28B:
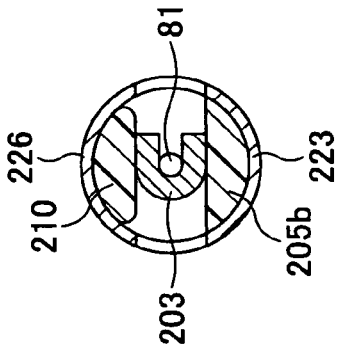
FIG. 28B shows a cross section taken along line B-B of FIG. 28A.
Figure 28B:
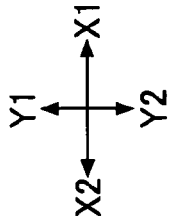
Figure 28A:
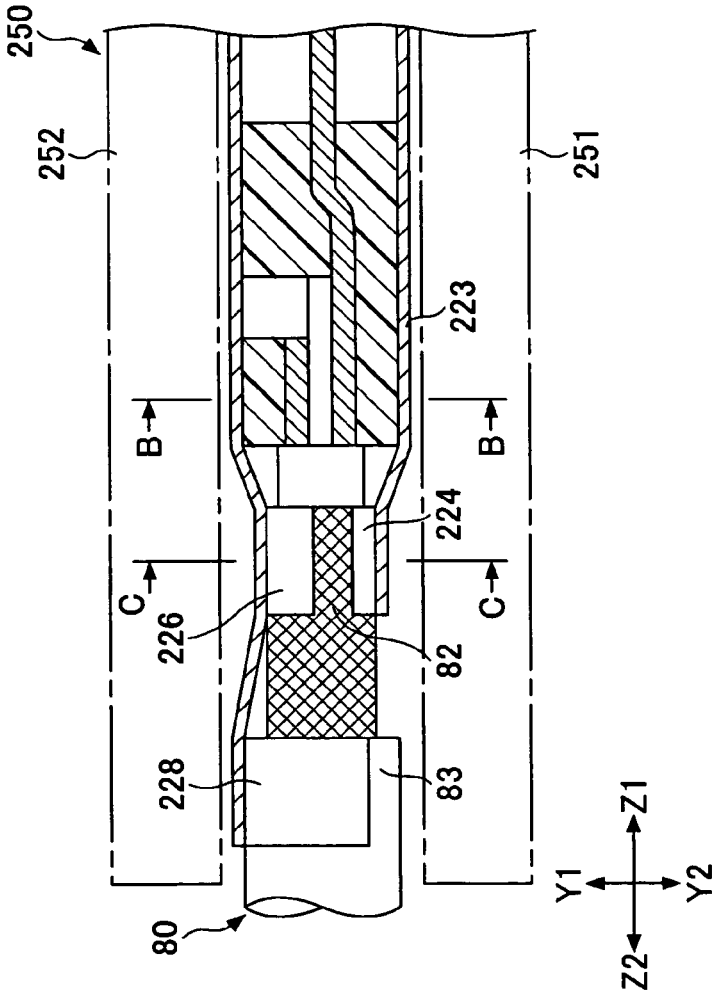
FIG. 28A shows a cross section of the coaxial-cable-side coaxial connector after being crimped.

As a result, the inner conductor 81, the outer conductor 82, and the sheath 83 of the coaxial cable 80 are simultaneously crimped, as shown in FIGS. 28A, 28B, and 28C as well as in FIG. 23.

Specifically, the inner conductor 81 of the coaxial cable 80 is fixed as the connecting portion 203 is crimped via the interposed member 210, as shown in FIG. 28B. The jutted-out base portion 205*b* is located on the Y2 side of the connecting portion 203, while the interposed member 210 is located on the Y1 side. The jutted-out base portion 205*b* and the interposed member 210 are crimped by the first portion 223 on the Y2 side and the first portion 226 on the Y1 side in the Y1-Y2 direction.

The outer conductor 82 of the coaxial cable 80 is crimped by the second portion 224 on the Y2 side and the second portion 227 on the Y1 side in the Y1-Y2 direction as shown in FIG. 28C.

The sheath 83 of the coaxial cable 80 is crimped by the third portion 228 on the Y2 side as shown in FIG. 28A.

Thus, the coaxial-cable-side coaxial connector 200 can be assembled without soldering, which would require much labor.

The foregoing embodiment can be adapted to the coaxial-cable-side coaxial connector 90 shown in FIG. 11.

The coaxial connectors in accordance with the present invention can be applied in signal transmission paths for frequencies of several 10 GHz or above, and may be suitably used for establishing connection with coaxial cables in various devices, including electronic measuring instruments, semiconductor testing equipment, computers, servers, switching machines, and routers.

Although the invention has been described with reference to particular examples, it will be appreciated by those skilled in the art that the invention may be embodied in many other forms.

The present application is based on the Japanese Priority Application No. 2007-174010 filed Jul. 2, 2007, the entire contents of which are hereby incorporated by reference.

What is claimed is:

1. A coaxial-connector-mounted structure comprising a coaxial connector and a substrate on which the coaxial connector is mounted, the coaxial connector comprising an insulating housing, a center conductor fixed to the housing, and a surrounding conductor fixed to the housing in such a manner as to surround the center conductor, the center conductor having a base portion that is exposed on a lower surface of the housing and surrounding conductor having a base portion that is exposed on the lower surface of the housing;

wherein the coaxial connector is mounted on the substrate with one or more fasteners such that the base portion of the center conductor and the base portion of the surrounding conductor are each continually pressed in a direction of a respective pad disposed on the substrate, the coaxial-connector-mounted structure further comprising a single conductive spacer disposed between the coaxial connector and the substrate, the conductive spacer being configured to become electrically conductive only in an area that is compressed by the base portion of the center conductor and the base portion of the surrounding conductor when the connector is mounted on the substrate with the one or more fasteners.

2. A coaxial-connector-mounted structure comprising plural coaxial connector units, an insulating housing in which the coaxial connector units are arranged, and a substrate on which the housing is mounted, each coaxial connector unit having a center conductor and a surrounding conductor that surrounds the center conductor, the center conductor having a base portion that is exposed on a lower surface of the housing and the surrounding conductor having a base portion that is exposed on the lower surface of the housing;

wherein the housing is mounted on the substrate with one or more fasteners such that the base portion of the center conductor and the base portion of the surrounding conductor each continually pressed in a direction of a respective pad disposed on the substrate, the coaxial-connector-mounted structure further comprising a single conductive spacer disposed between the coaxial connector units and the substrate, the conductive spacer being configured to become electrically conductive only in an area that is compressed by the base portion of the center conductor and the base portion of the surrounding conductor when the connector is mounted on the substrate with the one or more fasteners.

3. A coaxial-connector-mounted structure comprising a coaxial connector and a substrate on which the coaxial connector is mounted, the coaxial connector comprising an insulating housing, a center conductor fixed to the housing, and a surrounding conductor fixed to the housing in such a manner as to surround the center conductor, the center conductor having a base portion that is exposed on a lower surface of the housing and the surrounding conductor having a base portion that is exposed on the lower surface of the housing;

wherein the coaxial connector is mounted on the substrate with the base portion of the center conductor and the base portion of the surrounding conductor each pressed in a direction of a respective pad disposed on the substrate, the coaxial-connector-mounted structure further comprising at least one conductive ball disposed between the base portion of the center conductor and the pad corresponding to the center conductor on the substrate, and at least one other conductive ball disposed between the base portion of the surrounding conductor and the pad corresponding to the surrounding conductor on the substrate, the at least one conductive ball and the at least one other conductive ball being in an elastically deformed state and providing an electrical connection between the base portion of the center conductor and the pad corresponding to the center conductor on the substrate and between the base portion of the surrounding conductor and the pad corresponding to the surrounding conductor on the substrate.

4. A coaxial-connector-mounted structure comprising plural coaxial connector units, an insulating housing in which the coaxial connector units are arranged, and a substrate on which the housing is mounted, each coaxial connector unit having a center conductor and a surrounding conductor that surrounds the center conductor, the center conductor having a base portion that is exposed on a lower surface of the housing and the surrounding conductor having a base portion that is exposed on the lower surface of the housing;

wherein the housing is mounted on the substrate with the base portion of the center conductor and the base portion of the surrounding conductor each pressed in a direction of a respective pad disposed on the substrate, the coaxial-connector-mounted structure further comprising at least one conductive ball disposed between the base portion of the center conductor and the pad corresponding to the center conductor on the substrate, and at least one other conductive ball disposed between the base portion of the surrounding conductor and the pad corresponding to the surrounding conductor on the substrate, the at least one conductive ball and the at least one other conductive ball being in an elastically deformed state and providing an electrical connection between the base portion of the center conductor and the pad corresponding to the center conductor on the substrate and between the base portion of the surrounding conductor and the pad corresponding to the surrounding conductor on the substrate.

* * * * *